US007517285B2

(12) United States Patent
Ochi

(10) Patent No.: US 7,517,285 B2
(45) Date of Patent: Apr. 14, 2009

(54) BOWLING GAME SYSTEM

(75) Inventor: Yasushi Ochi, Izumisano (JP)

(73) Assignee: BLD Oriental, Ltd., Osaka (JP)

( * ) Notice: Subject to any disclaimer, the term of this patent is extended or adjusted under 35 U.S.C. 154(b) by 189 days.

(21) Appl. No.: 11/577,197

(22) PCT Filed: Oct. 12, 2005

(86) PCT No.: PCT/JP2005/018757

§ 371 (c)(1),
(2), (4) Date: Apr. 13, 2007

(87) PCT Pub. No.: WO2006/041073

PCT Pub. Date: Apr. 20, 2006

(65) Prior Publication Data

US 2008/0032808 A1 Feb. 7, 2008

(30) Foreign Application Priority Data

Oct. 15, 2004 (JP) ..... 2004-301589

(51) Int. Cl.
*A63D 1/04* (2006.01)

(52) U.S. Cl. ..... 473/55; 473/113

(58) Field of Classification Search ..... 473/54, 473/55, 56, 106, 113, 115; 273/129 AP
See application file for complete search history.

(56) References Cited

U.S. PATENT DOCUMENTS

| | | | | |
|---|---|---|---|---|
| 5,380,251 | A * | 1/1995 | Heddon | 473/109 |
| 5,405,295 | A * | 4/1995 | Lord | 473/55 |
| 5,830,073 | A * | 11/1998 | Voss | 473/54 |
| 5,857,918 | A * | 1/1999 | Beene | 473/55 |
| 6,402,629 | B1 * | 6/2002 | Heddon | 473/55 |
| 6,988,953 | B2 * | 1/2006 | Kuoppa et al. | 473/113 |
| 7,052,404 | B2 * | 5/2006 | Heddon | 473/113 |
| 7,063,622 | B1 * | 6/2006 | Luoma | 473/54 |
| 7,070,510 | B2 * | 7/2006 | Heddon | 473/55 |

* cited by examiner

*Primary Examiner*—William M Pierce
(74) *Attorney, Agent, or Firm*—Westerman, Hattori, Daniels & Adrian, LLP.

(57) ABSTRACT

This invention relates to a bowling game system that prevents a ball from falling into one of gutters with no players noticing. A bowling game system 1 is provided with an approach 2 where a player rolls a bowling ball b down, a lane 3 on which the ball b players bowl rolls, a plurality of bowling pins 5 arranged and placed on the end of the lane 3 opposite to the approach 2, trough-like gutters 4 provided longitudinally on the both sides of the lane 3 to receive the ball b slipping from the lane 3, a plurality of nozzles 21 provided face to face longitudinally on the outer sides of the lane 3 and a compressed air supplying source 25 providing the nozzles 21 with compressed air via supplying pipes 22. The nozzles 21 discharge compressed air toward the inside of the lane 3 to prevent the ball b from falling into one of the gutters 4, which is not revealed to players, because the compressed air is transparent and clear.

31 Claims, 11 Drawing Sheets

Fig. 5

| Handicap | Guided frame count |
|---|---|
| 0 - 20 | 0 |
| 21 - 40 | 1 |
| 41 - 60 | 2 |
| 61 - 80 | 3 |
| 81 - 100 | 4 |
| 101 - 120 | 5 |
| 121 - 140 | 6 |
| 141 - 160 | 7 |
| 161 - 180 | 8 |

BOWLING GAME SYSTEM

TECHNICAL FIELD

The present invention relates to a bowling game system in which for enjoyment a ball is rolled down a lane at the head of which a group of pins is arranged into place, and the pins are knocked down by the rolling ball.

BACKGROUND ART

Such bowling game systems are configured with: an approach where players roll a ball; a lane extending from the approach and on which the ball rolls; a group of pins placed on the end of the lane opposite the approach; and trough-like gutters lying on either side of the lane and receiving balls slipping off the lane. Players enjoy the game by competing with each other for a higher score that depends on the number of pins they knock down.

Of course, how many pins players are able to knock down depends on the direction in which the ball is rolled—that is, players' scores are determined by which part of the arranged pins their balls strike, and on the players' skill at controlling the ball.

Being not yet fully developed physically, children are not able to control very well the direction in which the ball rolls, and consequently cannot hope for a high score, or as is likely to happen, they are able to knock down only a few pins because the ball always falls into the gutter. In such cases, children lose interest in the bowling game, and are left unable to enjoy household bowling outings with the object of interacting as a family.

In light of such considerations, various gutter-ball prevention apparatuses for preventing a bowled ball from falling into the gutter have been proposed to date. One such apparatus is configured so that bars, which are placed along both sides of the lane, simultaneously shift horizontally between a blocking position near the edge of the lane, where the bars prevent the ball from falling into the gutter, and a retract position near the edge of the gutters, where the bars shift from the blocking position. (Reference is made to Japanese Unexamined Pat. App. Pub. Nos. H7-155424, No. H9-84923 and No. H11-164931.)

In accordance with this gutter prevention apparatus, the bars shift into the blocking position when players, such as young children, unable to control a ball well bowl, and shift into the retract position when physically more developed adolescent players bowl.

Thus, even if a ball rolled by a juvenile player unable to control the direction of the rolling ball well rolls toward a gutter, the bars shift into the blocking position to prevent the ball from falling into the gutter keeping it on the lane, such that the ball runs into the pins and knocks down some of them as a result. In other words, even children are able to always knock down some of the pins and score.

The bars are shifted into the retract position when non-children players bowl, so that any gutter balls they bowl will fall directly into the gutter without being blocked.

The fact that this gutter prevention apparatus allows children to always knock down some of the pins and score encourages them to maintain interest in the game. Moreover, children are able to bowl along with adolescent and older players in the same lane, so that they are able to enjoy a household bowling outing and interact as a family.

Additionally, the following apparatuses have been also proposed: an apparatus configured so that bars simultaneously shift vertically between a blocking position and a retract position lower than the blocking position (cf. Japanese Unexamined Pat. App. Pub. Nos. H10-151235 and 2002-65933), and an apparatus configured so that the gutters rotate toward the lane about axes paralleling the lane lengthwise (cf. Japanese Unexamined Pat. App. Pub. No. H10-506031). Both of these apparatuses play the same role as that of the apparatus explained in the foregoing.

Patent Document 1: Japanese Unexamined Pat. App. Pub. No. H7-155424.

Patent Document 2: Japanese Unexamined Pat. App. Pub. No. H9-84923.

Patent Document 2: Japanese Unexamined Pat. App. Pub. No. H11-164931.

Patent Document 2: Japanese Unexamined Pat. App. Pub. No. H10-151235.

Patent Document 2: Japanese Unexamined Pat. App. Pub. No. 2002-65933.

Patent Document 2: Japanese Unexamined Pat. App. Pub. No. H10-506031.

DISCLOSURE OF INVENTION

Problem Invention is to Solve

Conventional gutter-ball prevention devices, however, are less than adequate to maintain a child's interest in a bowling game and allow them to enjoy household bowling outings, because the child can see the ball they rolled being prevented from slipping into one of the gutters by the bar elements, so that they recognize they were able to knock down pins owing to the gutter-ball prevention devices, not their own ability.

An object of the present invention, brought about in view of the circumstances explained in the foregoing, is to provide a bowling game system for preventing, without being noticed by the players, the bowling ball from slipping into one of the gutters.

Means for Resolving the Problems

The present invention for achieving the above-stated object involves a bowling game system furnished with: an approach where players bowl a ball; a lane extending from the approach and on which a ball bowled by a player rolls; a plurality of bowling pins arranged on the end of the lane opposite the approach; and trough-like gutters lying on either side of the lane, for receiving balls slipping off the lane; the bowling game system further provided with a discharging mechanism for discharging pressurized gas at a ball rolling down the lane, whereby the ball is prevented by the discharged pressurized gas from falling into one of the gutters, and with a gas supplying means for feeding the pressurized gas to the discharging mechanism to discharge the gas.

In accordance with this bowling game system, when players roll a ball down the lane, the ball continues to roll down the lane toward the pins to strike them, while being prevented from falling into the gutters by the pressurized gas fed by the gas supplying means to, and discharged from, the discharging mechanism.

Additionally, because the pressurized gas is transparent and colorless, the players do not recognize that the pressurized gas prevents the ball from falling into the gutters, so that the players are made to believe that they could roll the ball at the pins to knock down them, in the players' own.

In this way, the bowling game system involving the present invention enables even children not good at controlling the direction of rolling a ball to keep on scoring by unfailingly knocking down some of the pins, and makes the children to believe that their skill should be improved, so that they are able to enjoy family bowling outings without losing interest in bowling games.

It is to be noted that the discharging mechanism may be configured with a plurality of discharging means for discharging pressurized gas toward the lane, the discharging means being disposed longitudinally on the outer sides of the lane, and the gas supplying means may be configured so as to feed the discharging means with the pressurized gas. In these configurations, the pressurized gas discharged by the discharging means from the outer sides of the lane toward the inside of the lane prevents the ball from falling into the gutters.

Here, advantageously, for example, the plurality of discharging means are disposed longitudinally on the outer sides of the lane in a configuration staggered on either side, or are disposed facing each other on the outer sides of the lane as pairs, with a plurality of such pairs being arranged paralleling the lane. Additionally, an orientation in which the pressurized gas is discharged from the discharging means is preferably controlled so as to direct diagonally from the direction perpendicular to the lane toward the pins. In such a configuration, the pressurized gas is discharged at the ball from behind with respect to a moving way of the ball, so that the ball is not only prevented from falling into one of the gutters but also accelerated to a higher moving speed. The higher the moving speed of the ball, the greater the energy developed when the ball collides with the pins, so that children who roll a ball only at a low speed are enabled to knock down more pins.

Furthermore, the bowling game system may have a configuration further provided with position detecting means for detecting the widthwise ball position on the lane, in position-detecting locations arranged so as to be in one-to-one correspondence with the discharging means, and be nearer to the approach end tan the corresponding discharging means, and with a control means for controlling the gas supplying means so that the pressurized gas is fed to, and is discharged from, the discharging means for a fixed duration, depending on in which position-detecting locations the ball position has been detected, when the ball is determined to be in predetermined lane-bordering regions by confirming whether or not the ball is in predetermined lane-bordering regions along where the discharging means corresponding to the position-detecting locations are disposed, from the ball position in the position-detecting locations, the ball position being detected by the position detecting means in turn.

In such a configuration, whether or not the ball position is in the lane-bordering regions along where the discharging means are disposed (that is, whether or not the ball is rolling in the lane-bordering regions) is confirmed from the ball position in the position-detecting locations, the ball position being detected by the position detecting means in turn, and the pressurized gas is discharged from the discharging means when the ball is determined to be in the lane-bordering regions, so that the ball rolling on the center of the lane is efficaciously prevented, for example, from being inexpediently guided toward the gutters by pressurized gas.

Furthermore, the control means may be configured as follows: the gas supplying means is controlled so as adjust a flow rate and/or pressure of the pressurized gas fed to the discharging means corresponding to the position-detecting locations to vary a flow rate and/or pressure of the pressurized gas discharged from the discharging means so that the ball is guided toward a predetermined part of the pins, depending on the ball position in the position-detecting locations, the ball position being detected by the position detecting means in turn.

In such a configuration, depending on the ball position in the position-detecting locations, being detected by the position detecting means in turn a flow rate and/or pressure of the pressurized gas supplied to the discharging means corresponding to the position-detecting locations to vary a flow rate and/or pressure of the pressurized gas discharged from the discharging means, so that the ball rolling down the lane is guided toward the predetermined part of the pins with its widthwise position on the lane being controlled by the adjusted pressurized gas (that is, at the first attempt, the ball is guided toward the center of the pins, and at second attempt, the ball is guided toward the pins left upright after the first attempt).

For example, when a ball is rolling on a first edge of the lane, the ball is moved toward the center of the lane by raising the flow rate and pressure of the pressurized gas discharged from any of discharging means, being laid along the first edge, and the ball is continued to roll on the first edge of the lane by reducing the flow rate and pressure of the pressurized gas discharged from the discharging means to zero (that is, discharging pressurized gas is stopped), or when the ball is rolling down the center of the lane, the ball is moved toward the first edge of the lane by raising the flow rate and pressure of the pressurized gas discharged from any of the discharging means, being laid along a second edge opposite to the way in which the ball is moved, and the ball is continued to roll down the center of the lane by reducing a flow rate and pressure of the pressurized gas discharged from the discharging means to zero.

Guiding the ball in such a way enables children to always knock down many of the pins, and to sometimes get a spare and strike. Besides, even if they bowl with non-children players on one lane, children are able to get a high score that favorably compares with non-children players, so that they are able to enjoy family bowling outings competing with each other as players at the same level without losing interest in bowling games.

Moreover, the bowling game system may have a configuration further provided with detecting means for detecting the widthwise position, moving speed and moving way of the ball on the lane, in proximity to the approach end, apart from a closest one to the approach among the discharging means, and with a control means for controlling the gas supplying means so as to time, based on the ball speed detected by the detecting means, pressurized gas-feeding to when the ball passes in front of the discharging means with respect to the orientation of discharge to feed the discharging means with the pressurized gas so that the pressurized gas is discharged for a fixed duration, depending on determination as to from which of the discharging means the pressurized gas is to be discharged in order to prevent the ball from moving into the predetermined lane-bordering regions, the determination being made by predicting the ball moving path as the basis of the determination, form the ball position and moving way detected by the detecting means.

In this configuration, the widthwise position, moving speed and moving way of the ball rolling down the lane are detected by the detecting means, and the gas supplying means is controlled by the control means, based on the detected ball position, moving way and moving speed. It is to be noted is the ball position is detection in two locations, for example, the ball moving way can be detected based on the detected ball positions and the distance between the two locations.

That is, the moving path of the ball is predicted from the detected ball position and moving way, and from which of the discharging means the pressurized gas is to be discharged in order to prevent the ball from moving into the lane-bordering regions is determined based on the predicted moving path, before the pressurized gas is discharged from the determined one of the discharging means, timed to when the ball passes, based on the detected ball speed.

For example, if in proximity to one of the discharging means, being disposed third from the approach end, the ball is confirmed from the predicted moving path to enter either of the lane-bordering regions, being along where the third one of the discharging means is disposed, the pressurized gas is discharged from the third one of the discharging means, and as needed from the second and fourth ones, so that the ball is prevented from moving into (enter) the lane-bordering regions. Therefore, also in this way, as described in the foregoing, the pressurized gas is discharged from the discharging means only when needed.

Additionally, the control means may be configured so as to control the gas supplying means to time, based on the ball speed detected by the detecting means, pressurized gas-feeding to timed to when the ball passes in front of the discharging means with respect to the orientation of discharging so that the pressurized gas with a flow rate and/or pressure meeting the flow rate and/or pressure of the pressurized gas that is to be discharged is fed to the discharging means, depending on determination as to from which of the discharging means the pressurized gas is to be discharged and how much flow rate and/or pressure of pressurized gas is to be discharged from it in order to guide the ball toward a predetermined part of the pins, the determination being made by predicting the ball travel path as the basis for the determination, from the ball position and moving way detected by the detecting means.

In such a configuration, the moving path of the ball is predicted from the detected ball position and moving way, and from which of the discharging means the pressurized gas is to be discharged and how much flow rate and/or pressure of pressurized gas is to be discharged from it in order to guide the ball toward the predetermined part of the pins are determined based on the predicted moving path, before the determined flow rate and/or pressure of pressurized gas is discharged from the determined one of the discharging means, timed to when the ball passing, based on the detected ball speed, so that the same effect as explained in the foregoing is obtained also in this way.

Additionally, the discharging mechanism may be configured with two discharging means disposed face to face on outer sides of the lane, for discharging the pressurized gas toward the lane, and drive means for sliding the discharging means along the lane, while supporting them, and the gas supplying means may be configured so as to feed the discharging means with the pressurized gas, and the bowling game system may have a configuration further provided with speed detecting means for detecting the ball moving speed, in proximity to the approach end, apart from fields in which the discharging means are able to slide, and with a control means for controlling the drive means so as to slide the discharging means from a vicinity of the approach end toward the pins to keep pace with the ball at a speed corresponding to the ball speed detected by the speed detecting means so that the ball is in front of the discharging means with respect to the orientation of discharging, and meanwhile for controlling the gas supplying means so as to feed the discharging means with the pressurized gas to allow the pressurized gas to be discharged continuously or continually while the discharging means are sliding.

In these configurations, when players roll a ball down the lane and the ball runs on the lane toward the pins, the moving speed of the ball is detected by the speed detecting means and the drive means is controlled by the control means, so that the discharging means are slid from the vicinity of the approach end toward the pins at a speed corresponding to the detected ball moving speed to keep pace with the ball so that the ball is in front of the discharging means with respect to the orientation of discharging.

And then, the pressurized gas is fed from the gas supplying means to the discharging means to be discharged continuously or continually under the control of the control means while the discharging means are sliding, so that the ball is prevented from falling into one of the gutters by the pressurized gas discharged in this way, from the outer sides of the lane toward the center of the lane, bringing the same effect as described in the foregoing It is to be noted that discharging the pressurized gas continuously is more preferable because continuous discharge prevents the ball from falling into gutters more securely compared with continue one, and an orientation in which the pressurized gas is discharged from the two discharging means is preferably controlled so as to direct diagonally from a direction perpendicular to the lane toward the pins, as described in the foregoing.

Furthermore, the bowling game system may be further provided with position detecting means for detecting the widthwise ball position on the lane, in a plurality of position-detecting locations arranged paralleling the lane, and the control means may be configured so as to control the gas supplying means to feed at least either of the discharging means with the pressurized gas so that the pressurized gas is discharged for a fixed duration, depending on along which of predetermined lane-bordering regions the ball position has been detected, when the ball is determine to be in the lane-bordering regions by confirming whether or not the ball is preset in the regions, from the ball position in the position-detecting locations, the ball position being detected by the position detecting means in turn.

In this way, whether or not the ball is in the lane-bordering regions is confirmed from ball position in the position-detecting locations, detected by the position detecting means in turn, and then when the ball is determined to be in the regions, pressurized gas is discharged from at least one of the discharging means, depending on along which of the lane-bordering regions the ball position is detected, so that as explained in the foregoing, the ball rolling down the center of the lane is efficiently prevented from being guided inexpediently toward one of the gutters by the pressurized gas.

Besides, the control means may be configured as follows: the gas supplying means is controlled so as to adjust a flow rate and/or pressure of the pressurized gas fed to the discharging means to vary a flow rate and/or pressure of the pressurized gas discharged from the discharging means so that the ball is guided toward the predetermine part of the pins, depending on in which of the position-detecting locations the ball position is detected by the position detecting means in turn.

In this configuration, depending on the ball position in the position-detecting locations, detected by the position detecting means in turn, a flow rate and/or pressure of the pressurized gas fed to the discharging means is adjusted to vary a flow rate and/or pressure of the pressurized gas discharged from the discharging means, so that the ball rolling down the lane continues to roll, while guided toward the predetermined part of the pins by the adjusted pressurized gas as explained in the foregoing.

For example, when a ball is rolling down a first edge of the lane, the ball is moved toward the center of the lane by raising the flow rate and pressure of the pressurized gas discharged from one of the discharging means, being along the first edge and simultaneously by reducing the flow rate and pressure of the pressurized gas discharged from one of the discharging means, being along a second edge to zero (that is, discharging pressurized gas is stopped), and the ball is continued to roll down the first edge of the lane by reducing the flow rate and pressure of the pressurized gas discharged from the discharging means to zero, or when the ball is rolling down the center of the lane, the ball is moved toward the first edge of the lane by raising the flow rate and pressure of the pressurized gas discharged form one of the discharging means, being along the second edge opposite to the way in which the ball is moved and simultaneously by reducing the flow rate and pressure of the pressurized gas discharged from one of the discharging means, being along the first edge to zero, and the ball is continued to roll down the center of the lane by reducing the flow rate and pressure of the pressurized gas discharged form the discharging means to zero. Therefore, also in this way, the same effect as described in the foregoing is obtained.

Additionally, the bowling game system may be further provided with detecting means for detecting the widthwise position and moving way of the ball on the lane, in proximity to the approach end, apart from fields in which the discharging means are able to slide, and the control means may be configured so as to control the gas supplying means to feed the discharging means with the pressurized gas so that the pressurized gas is discharged while the discharging means are sliding in an interval in which the pressurized gas is to be discharged, depending on determination as to across how long the interval with respect to the orientation in which the discharge means slide discharging the pressurized gas is required and from which of the discharging means the pressurized gas is to be discharged in order to prevent the ball from moving into the predetermined lane-bordering regions, the determination being made by predicting the ball travel path as the basis for the determination, from the ball position and moving way detected by the detecting means.

In such a configuration, the widthwise position, moving speed and moving way of the ball rolling down the lane are detected by the detecting means, and the control means controls the gas supplying means so as to adjust the pressurized gas to control the discharging of the pressurized gas from the discharging means.

That is, the moving path of the ball is predicted from the detected ball position and moving way, and then across how long the interval discharging pressurized gas is required and from which of the discharging means the pressurized gas is to be discharged (that is, discharging means along which of edges is to discharge the pressurized gas) in order to prevent the ball from moving into the lane-bordering regions are determined based on the predicted moving path, before the pressurized gas is discharged from the determined one of the discharged means while the determined one of the discharging means is sliding in the determined interval, so that the same effect as described in the foregoing is brought.

Furthermore, the control means may be configured so as to control the gas supplying means to feed the discharging means with the pressurized gas with a flow rate and/or pressure meeting the flow rate and/or pressure of pressurized gas that is to be discharged so that the pressurized gas is discharged while one of the discharging means are sliding in an interval in which the pressurized gas is to be discharged, depending on determination as to across how long the interval with respect to the orientation in which the discharging means slide the pressurized gas is to be discharged, from which of the discharging means the pressurized gas is to be discharged, and how much flow rate and/or pressure of pressurized gas is to be discharged from it in order to guide the ball toward the predetermined part of the pins, the determination being made by predicting the ball travel path as the basis of the determination, from the ball position and moving way detected by the detecting means.

In such a configuration, the ball travel path is predicted from the detected ball position and moving way, and across how long the interval pressurized gas is to be discharged, from which of the discharging means the pressurized gas is to be discharged and how much flow rate and/or pressure of pressurized gas is to be discharged in order to guide the ball toward the predetermined part of the pins are determined based on the predicted moving path, before the determined flow rate and/or pressure of pressurized gas is discharged form the determined one of the discharging means, while the determined one of the discharging means is sliding in the determined interval, so that the same effect as described in the forgoing is obtained.

Moreover, the discharging mechanism may be configured with a plurality of discharging means disposed, embedded longitudinally in the edges of the lane, for discharging pressurized gas upwards, and the gas supplying means may be configured so as to feed the discharging means with the pressurized gas.

In these configurations, when players roll a ball down the lane and the ball runs on the lane, the ball continues to roll, while prevented from falling into the gutters by the pressurized gas fed by the gas supplying means to be discharged from the discharging means upwards, so that the same effect as described in the foregoing is obtained. It is to be noted that the discharging means are advantageously, for example, disposed longitudinally on the outer sides of the lane in a configuration staggered on either side, or are disposed facing each other along the lane as pairs, with a plurality of such pairs being arranged longitudinally on the outer sides of the lane.

The bowling game system may also have a configuration further provided with position detecting means for detecting the widthwise ball position on the lane, in position-detecting locations arranged so as to be in one-to-one corresponding to the discharging means, and be nearer to the approach end than corresponding discharging means, and with a control means for controlling the gas supplying means so as to feed the discharging means with the pressurized gas to allow the pressurized gas to be discharged for a fixed period of time, depending on in which of position-detecting locations the ball position has been detected, when the ball is determined to be in predetermined lane-bordering regions along where the discharging means corresponding to the position-detecting locations are disposed, by confirming whether or not the ball is in the regions, from the ball position in the position-detecting locations, detected by the position detecting means in turn.

If such a configuration is adopted, whether or not the ball is in the lane-bordering regions along where the discharging means are disposed (that is, whether or not the ball is rolling down one of the edges of the lane) is confirmed from the ball position in the position-detecting locations, detected by the position detecting means in turn, and the pressurized gas is discharged from the discharging means when the ball is determined to be in the regions, so that discharging pressurized gas is efficiently carried out.

Furthermore, the bowling game system may have a configuration further provided with detecting means for detecting the widthwise position, moving speed and moving way of the ball on the lane, in proximity to the approach end, apart from the closest one to the approach end among the discharging means, and with a control means for controlling the gas supplying means so as to time, based on the ball speed detected by the detecting means, pressurized gas-feeding to when the ball passes over where the discharging means lie to feed the discharging means with the pressurized gas for a fixed duration, depending on determination as to from which of the discharging means the pressurized gas is to be discharged in order to prevent the ball from moving into the predetermined lane-bordering regions, the determination being made by predicting the ball travel path as the basis for the determination, from the ball position and moving way detected by the detecting means.

In this configuration, the widthwise position, moving speed and moving way of the ball rolling down the lane are detected by the detecting means, and the gas supplying means is controlled by the control means, that is to say, the moving path of the ball is predicted from the detected ball position and moving way, and which of the discharging means is to discharge the pressurized gas in order to prevent the ball from moving into the lane-bordering regions is determined based on the predicted moving path, before the pressurized gas is discharged from the determined one of the discharging means, timed to when the ball passing, based on the detected ball speed. Therefore, discharging pressurized gas is efficiently carried out as described in the foregoing.

Additionally, the discharging mechanism may be configured so that a plurality of discharging means disposed, embedded widthwise in the lane as a single row or a plurality of rows and provided with a plurality of discharging portions for discharging pressurized gas upwards are arranged parallel to the lane, the gas supplying means may be configured so as to feed the plurality of discharging portions of the plurality of discharging means with the pressurized gas, and the bowling apparatus may have a configuration further provided with position detecting means that detect a widthwise ball position on the lane in detection-performing locations, where ball position detection is performed, arranged so as to be nearer to the approach end correspondingly than the plurality of discharging means, and a control means that controls the gas supplying means so that depending on the ball position sequentially detected by the position detecting means, in the detection-performing locations, a flow rate and/or pressure of the pressurized gas supplied to that of discharging portions of that of discharging means that corresponds to one detection-performing location where the ball position is detected is adjusted to vary a flow rate and/or pressure of the pressurized gas discharged from the discharging portions of the determined discharging means so that the ball is guided toward a predetermined part of the pins.

In this configuration, when a ball players bowl rolls down the lane, a ball position in the detection-performing locations where ball position detection is performed is sequentially detected by the position detecting means, and the gas supplying means is controlled by the control means, based on the ball position in the detection-performing locations, so that pressurized gas is discharged from that of discharging portion, which depends on the detected ball position, of that of discharging means that corresponds to one detection-performing location where the ball position is detected.

For example, when a ball rolling down a first edge of the lane is moved toward the center of the lane, that of discharging portion that lies under the ball surface close to the first edge with respect to a plumb plane paralleling the lane and passing through the center of the ball is recognized from the detected ball position, and then pressurized gas is discharged from that recognized discharging portion. On the other hand, when the ball rolling down the center of the lane is moved to the first edge of the lane, that of discharging portion that lies under the ball surface near a second edge, across the plumb plane from the first edge is recognized from the detected ball position, and then pressurized gas is discharged from the recognized discharging portion.

At this time, a flow rate and/or pressure of the pressurized gas discharged from the plurality of discharging portions is varied by adjusting a flow rate and/or pressure of the pressurized gas supplied to the plurality of discharging portions, depending on a ball position detected by the position detecting means, so that the ball rolling down the lane continues to roll, while guided toward a predetermined part of the pins by the adjusted pressurized gas. Therefore, the same effect as described above is obtained.

Besides, the discharging mechanism may be configured so that a plurality of discharging means disposed, embedded widthwise in the lane as a single row or several rows and provided with a plurality of discharging portions that discharge pressurized gas upwards are disposed paralleling the lane, the gas supplying means may be configured so as to feed the plurality of discharging portions of the plurality of discharging means with the pressurized gas, and the bowling game system may have a configuration further provided with detecting means that detect, a widthwise position, moving speed and moving orientation of a ball on the lane, and with a control means that predicts a moving path of the ball, based on the ball position and moving way detected by the detecting means, determines based on the predicted pathway, which of the plurality of discharging means and portions are to discharge pressurized gas and how much flow rate and/or pressure of pressurized gas is to be discharged from that of discharging means that has be determined in order to guide the ball toward a predetermined part of the pins, and controls the gas supplying means so that a flow rate and/or pressure, corresponding to the determined discharge flow rate/and pressure, of pressurized gas is supplied to that of that of discharging portion that has been determined, timed to when the ball basses on the discharging portions of that of determined discharging means that has been determined, based on the ball speed detected by the detecting means.

In these configurations, a moving path of a ball is predicted based on a widthwise position and moving speed of the ball on the lane, detected by the detecting means, and which of the plurality of discharging means and portions is to discharge pressurized gas and how much flow rate and/or pressurized gas is to be discharged in order to guide the ball toward a predetermined part of the pins are determined based on the predicted pathway, before the determined flow rate and/or pressure of pressurized gas is discharged from the discharging portions of that of discharging means that has been determined, timed to when the ball passes, based on the ball moving speed detected by the detecting means, so that the same effect as described in the foregoing is produced.

In addition, for discharging pressurized gas from the plurality of discharging means (discharging portions), the control means is preferably provided and configured so that in which frames the gas supplying means is activated during the game is determined based on the handicaps determined depending on players' skill, before the progress of the game is monitored to allow the gas supplying means to feed the discharging means with pressurized gas when players bowl in the frames.

Preventing a ball from slipping into one of the gutters and guiding it whenever players roll a ball enables them to get always a high score regardless of their skill. This may have the opposite effect to what is intended, resulting in their loss of interest in the game. Therefore, if the frames in which the gas supplying means is actuated are determined based on the handicaps that depend on players' skill and the pressurized gas is fed to the discharging means only in the determined frames, players' real abilities are handicapped to make them apparently equal in their skill, allowing them to enjoy a so-called fight with real swords during the game.

In a bowling game, the score rises depending on how many times players get a strike consecutively and how many pins they knock down on their first attempt subsequent to the frame in which they get a spare, as well as on the total number of pins they knock down in each frame. Therefore, even if the players get a strike or a spare owing to the operation of the assisting system in an assist frame, their scores do not always rise depending on the results (strike, spare or open frame) prior to and subsequent to the assist frame. That is, even if the ball is prevented from slipping into the gutter and guided, players' score has variability, which keeps a bowling game enjoyable to prevent the players from losing interest in the game.

Effects of the Invention

In accordance with the present invention provided with the configuration explained in the foregoing, discharging pressurized gas prevents a ball from falling into one of the gutters with giving players no recognition, so that players are able to enjoy household bowling game outings without losing interest in bowling games.

BRIEF DESCRIPTION OF DRAWINGS

FIG. 5 is a data table stored in an execution data storage involving the first embodiment of the present invention, the data table in which a correlation between handicap and a number of assist frames is determined.

LEGEND

1: bowling game system; 2: approach; 3: lane; 4: gutters; 5: bowling pins; 20: guides; 21: nozzles; 22: supplying pipes; 23, 24: flow rate controlling mechanisms; 25: compressed-gas supply source; 26: position detecting mechanism; 27: position detecting sensor; 40: controller; 41: machine controller; 45: guide-executing processor; 46: player data storage; 47: execution data storage

BEST MODE FOR CARRYING OUT THE INVENTION

Figure 1:
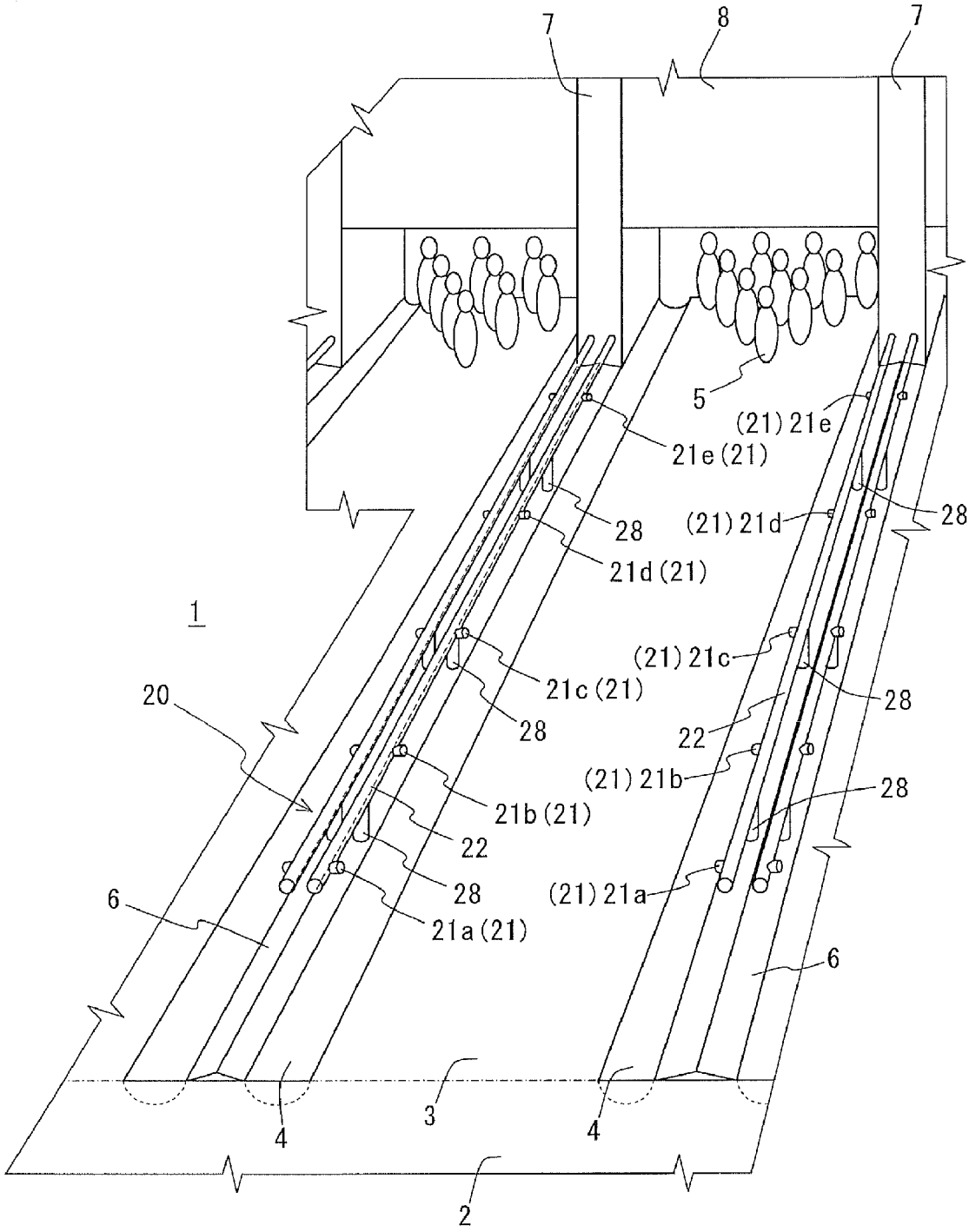
FIG. 1 is a perspective view illustrating an outlined configuration of a bowling game system involving a first embodiment of the present invention.
Figure 2:
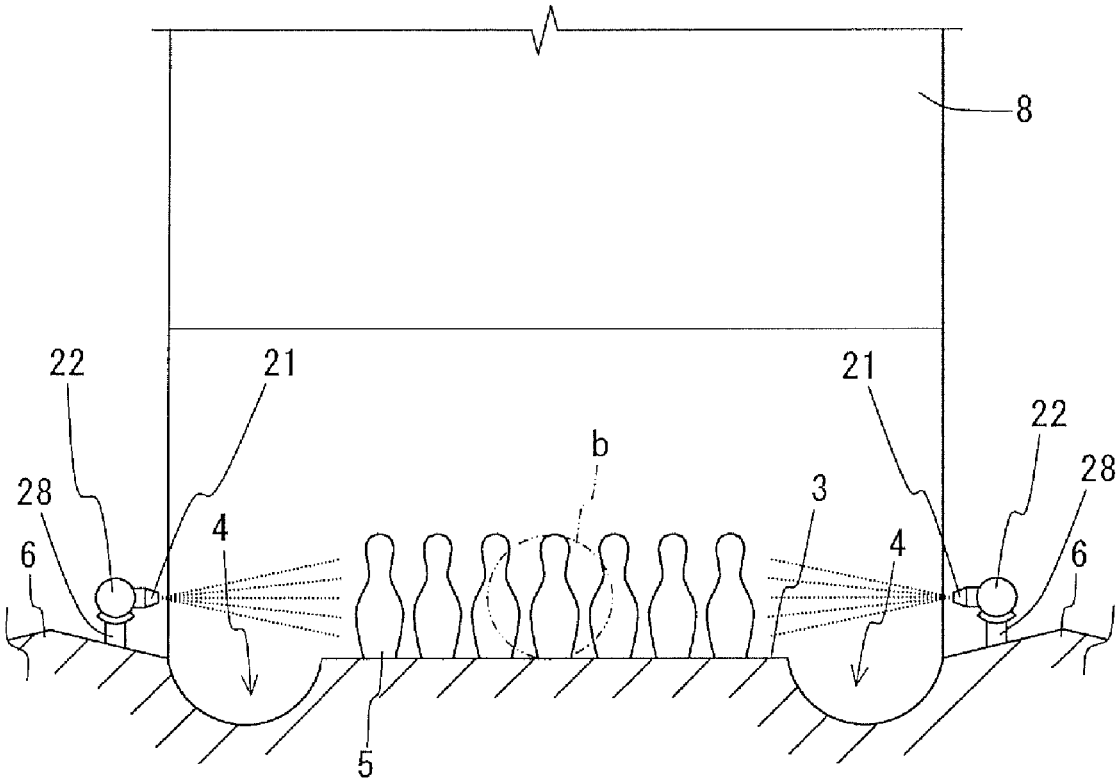
FIG. 2 is a cross-sectional view illustrating the bowling game system of FIG. 1.

A specific embodiment of the present invention is explained hereinafter with reference to the accompanying drawings. FIG. 1 is a perspective view illustrating an outline configuration of a bowling game system involving one embodiment of the present invention; while FIG. 2 is a sectional end view, and FIG. 3 a plan view thereof. FIG. 4 is a block diagram illustrating an outline configuration including a control scheme in the bowling game system involving in the present embodiment.

Figure 3:
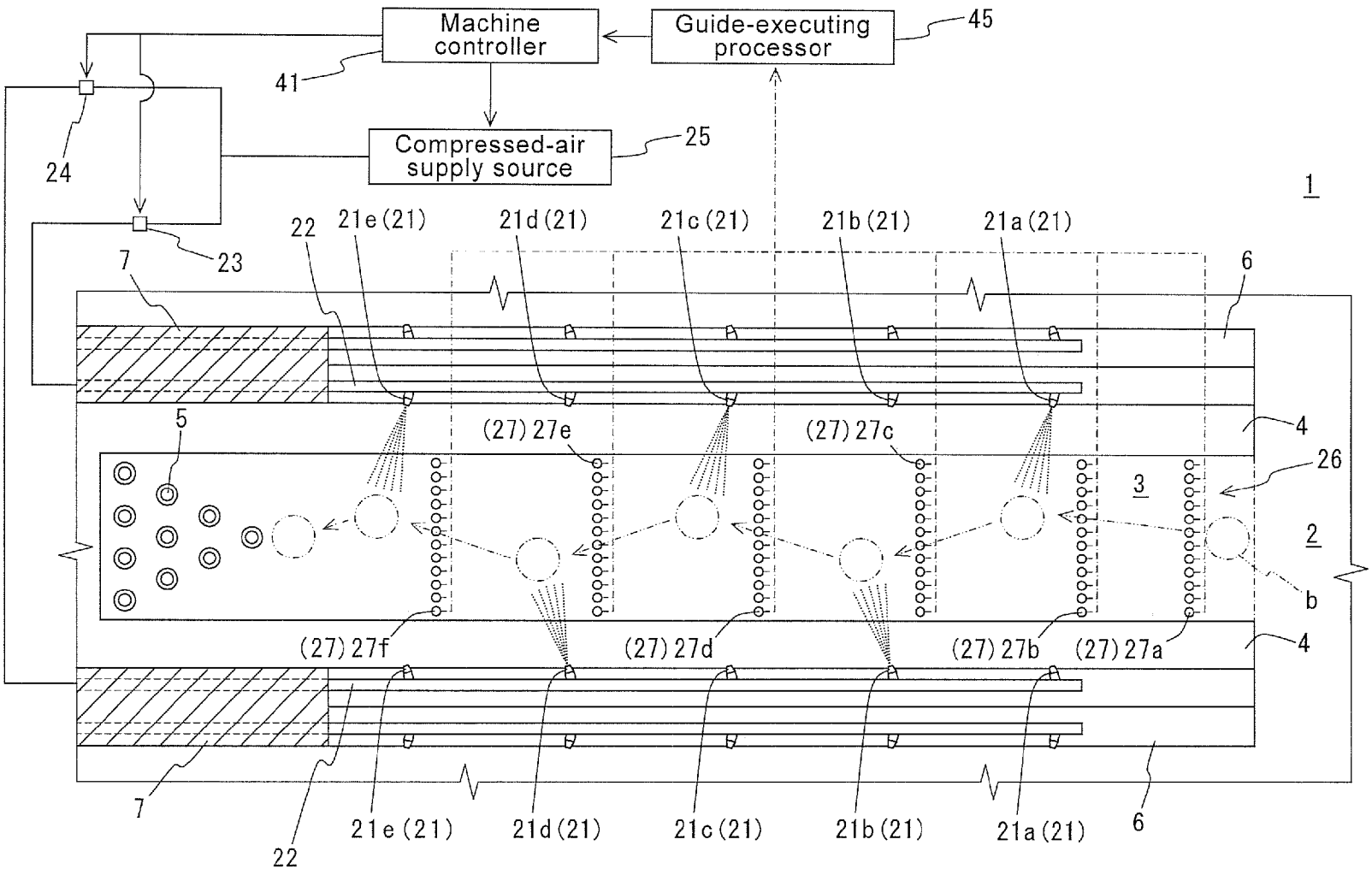
FIG. 3 is a plain view illustrating the bowling game system of FIG. 1.
Figure 4:
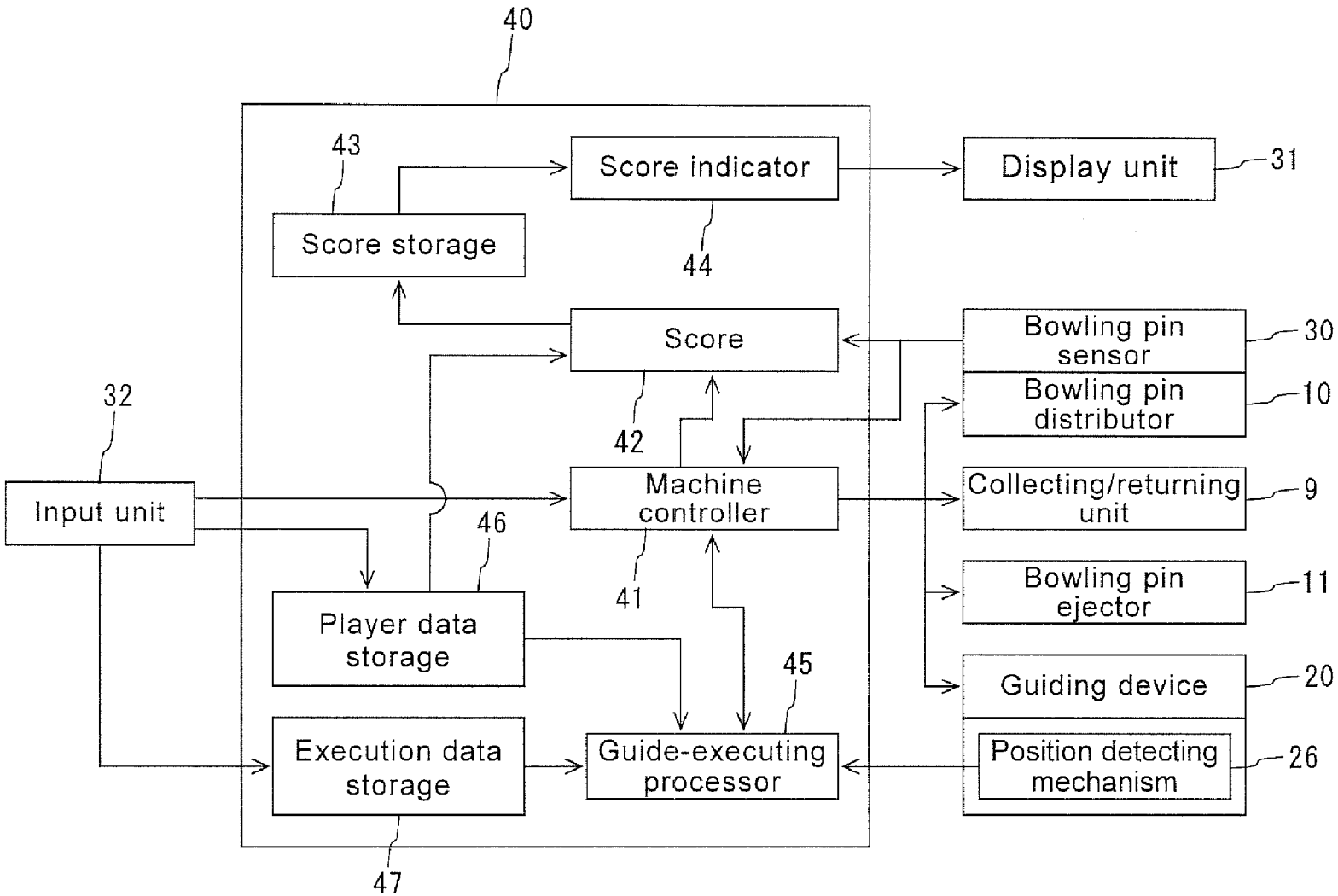
FIG. 4 is a block diagram illustrating an outlined configuration including control scheme of the bowling game system involving a first embodiment of the present invention.

As illustrated in FIGS. 1 to 3, a bowling game system 1 of this embodiment comprises an approach 2 as an area where players roll a bowling ball b down, a lane 3 extending form the approach 2 and on which the ball b rolls, ten bowling pins 5 arranged on the end of the lane 3 opposite the approach 2, trough-like gutters 4, 4 provided paralleling the both sides of the lane 3 and guides 20 for leading the ball b rolling down the lane 3 toward a given part of the pins 5, and the bowling game system 1 is configured with adjacently placed plural sets of them.

A separator 6, which is provided between adjacent the gutters 4, 4, separates play zones configured with the lane 3 and the gutters 4, 4. A partition wall 7, which is provided between the adjacent gutters 4, 4 near where the pins 5 are placed, also separates the play zones. A front-cover 8 is provided over the lane 3 between the walls 7, 7 and the pins 5 are placed on the lane 3 in the space partitioned by the front-cover 8 and the walls 7, 7.

In each area partitioned by the walls 7, 7 and the front-cover 8, a bowling pin distributor 10 and a bowling pin ejector 11 are provided, and the lane 3 extends to where a collecting/returning unit 9 is disposed to collect the ball b that comes rolling down the lane 3 or the gutter 4 and the pins 5 ejected from the lane 3 and to return them to the approach 2 and the pin distributor 10 respectively.

The pin distributor 10 is a device moving up and down to place the pins 5 upright on the lane 3, and the pin ejector 11 is a device for sending out the pins 5 left on the lane 3 or in the gutter 4 toward the collecting/returning unit 9. The pin distributor 10 and the pin ejector 11 are controlled by a controller 40 to operate in synchronization with each other.

Specifically, with the 10 pins 5 placed upright on the lane 3, players roll a ball on their first attempt and the ball reaches the collecting/returning unit 9, when the pin distributor 10 moves down to grasp the pins 5 left upright on the lane 3, and then moves up with the pins 5 grasped. As illustrated in FIG. 4, the pin distributor 10 is furnished with a pin sensor 30, which detects how many pins are grasped (the number of pins left upright) and what number pins are left upright (the locations of pins left upright).

Next, if the pin distributor 10 grasps some of the pins 5, the pin ejector 11 activates to eject all of pins 5 left knocked down on the lane 3 and in gutters 4 toward the collecting/returning unit 9, and then the pin distributor 10 moves down to place the grasping pins 5 on the lane 3, before the pin distributor moves up to complete the pin distribution after players' first attempt.

When players roll the ball b on their second attempt and it reaches the collecting/returning unit 9, the pin ejector 11 activates to eject all of pins 5 left on the lane 3 and in the gutters 4 toward the collecting/returning unit 9, subsequently the pin distributor 10 moves down to place the 10 pins 5 on the lane 3, before the pin distributor moves up to complete the pin distribution after players' second attempt (before their first attempt).

On the other hand, when the pin distribution after players' first attempt is carried out, if the pin distributor 10 grasps no pins 5—that is, if a strike is scored, the pin ejector 11 activates to eject pins 5 left knocked down on the lane 3 and found in the gutter 4 toward the collecting/returning unit 9, and then the pin distributor 10 moves down to place ten pins 5 on the lane 3, before the pin distributor 10 moves up to complete the pin distribution.

Guides 20 are configured with a plurality of nozzles 21 disposed facing each across the lane 3 and the gutters 4, 4 over the separators 6, two supplying pipes 22 provided over the separations 6, and on which nozzles 21 are mounted, a compressed-gas supply source 25 connected to the supply pipes 22 via flow rate controlling mechanisms 23, 24 to feed the supplying nozzles 21 with compressed gas, and a position detecting mechanism 26 that detects a widthwise positions of the ball b on the lane 3 in a plurality of locations along the lane 3. The flow rate controlling mechanisms 23, 24 and the compressed-gas supply source 25 are controlled by the controller 40.

The nozzles 21, which faces each other as a pair, with a plurality of the pairs being disposed paralleling the lane 3, are configured so as to discharge the compressed gas supplied from the compressed-gas supply source 25 in a orientation horizontal, and meanwhile directed diagonally from a direction perpendicular to the lane 3 toward the pins 5, with approximately the same height position as the center of the ball b in an area, where the ball b rolls, on the lane. The pairs of the nozzles 21 are called first nozzles 21*a*, second nozzles 21*b*, third nozzles 21*c*, fourth nozzles 21*d* and fifth nozzles 21*e* respectively from a pair closest to the approach 2.

The supplying pipes 22, which are retained by supporting members 28 planted on the separators 6, are disposed paralleling the lane 3 with first ends of the supporting members 28 being inserted into the walls 7 and with their second ends being connected to the compressed-gas supply source 25.

The flow rate controlling mechanisms 23, 24, which adjust a flow rate of the compressed gas supplied to the supplying pipes 22—that is, a flow rate of the compressed gas discharged from the nozzles 21 is adjusted, function as a gas supplying means described in the claims, together with the supplying pipes 22 and the compressed-gas supply source 25.

The position detecting mechanism 26 is provided with a plurality of position detecting sensors 27 embedded widthwise in the lane 3, and comprising a proximity switch as a set, with a plurality of such sets being disposed so as to be nearer to the approach 2 correspondingly than the pairs of the nozzles 21.

The sets of the position sensors 27 are called a first sensor row 27*a*, a second sensor row 27*b*, a third sensor row 27*c*, a fourth sensor row 27*d*, a fifth sensor row 27*e* and a sixth sensor row 27*f* respectively from a sensor row closest to the approach 2, and the second sensor row 27*b*, the third sensor row 27*c*, the fourth sensor row, the fifth sensor row 27*e* and the sixth sensor row 27*f* correspond to the first nozzles 21*a*, the second nozzles 21*b*, the third nozzles 21*c*, the fourth nozzles 21*d* and the fifth nozzles 21*e* respectively.

As illustrated in FIG. 4, the controller 40 is provided with a machine controller 41, a score calculator 42, a score storage 43, a score indicator 44, a guide-executing processor 45, a player data storage 46 and an execution data storage 47, and the machine controller 41 controls the activations of the bowling pins distributor 10, the bowling pin ejector 11, the collecting/returning unit 9 and the guides 20 (the flow rate controlling mechanisms 23, 24 and the compressed-gas supply source 25).

The player data storage 46 is a functional part for storing players' data input from an external input unit 32, such as name, sex, age, handicap and personal data of and the bowling order of players who bowl on the given lane.

The score calculator 42 reads out players' data from the player data storage 46 to recognize their personal data and bowling order, receives control data from the machine controller 41 to recognize progress of the game, receives data on the pins 5 each player knock down to calculate individual scores, and stores data on the calculated scores and the players' data in the score storage 43.

The score indicator 44 reads out the players' individual scores and personal data stored in the score storage 43 to indicate them on a display unit 31 such as screen. The display unit 31 is installed in the location where players can see the indication from an area as waiting position for players near the approach 2 (for example, the location over the waiting position) so that players check the indication on the display unit 31 to know the progress of the game and their scores.

The guide-executing processor 45 recognizes players' handicaps stored in the player data storage 46 to determine, based on the recognized handicaps, in which frames the guides 20 (the compressed-gas supply source 25 and the flow rate controlling mechanisms 23, 24) are activated during the game, and subsequently monitors the progress of the game to perform the processing in which the ball b is guided, when the players bowl in the determined frames.

Specifically, player's handicap and bowling order are recognized first, and then the recognized handicap is compared with a data table, in which correlation between the handicap and the number of guide frames is defined as illustrated in FIG. 5, stored in the execution data storage 47, to obtain the number of guide frames, and in which frames the ball b is guided for players is determined based on the obtained number.

The data table shown in FIG. 5 is entered through the input unit 32 to be stored in the execution data storage 47. The guide-executed frames in which guiding is performed may be determined, for example, by previously creating several patterns relating to combination of guide frames so that one is randomly selected from the patterns, or by using random numbers.

Subsequently, instructions to start a game are output to the machine controller 41 to permit players to start the game. After that, control data, which is received any time from the machine controller 41, is put together with the bowling order information stored in the player data storage 46 to monitor the progress of the game for players until the game is over.

In the guide-executed frames determined as described in the foregoing, guiding the ball b is carried out based on a detection signal sequentially received from the first sensor row 27*a*, the second sensor row 27*b*, the third sensor row 27*c*, the fourth sensor row 27*d*, the fifth sensor row 27*e* and the sixth sensor row 27*f*. It is to be noted that on players' first attempt, the ball b is guided toward the center of the pins 5, and on their second attempt, the ball b is guided toward the pins 5 left upright after their first attempt.

First, the process on players' first attempt will be explained. As a result of the rolling of the ball b, the detection signal is received from the first and second sensor rows 27*a*, 27*b*, and then a widthwise position of the ball b rolling down the lane 3 is recognized, based on which of the position detecting sensors 27 included in the first and second sensor rows 27*a*, 27*b* detects the ball b, to recognizes which of nozzles 21 included in the first nozzles 21*a* is closer to the ball b. Additionally, the amount of ball position change is calculated from the ball positions detected by the first and second sensor rows 27*a*, 27*b* to work out a moving way of the ball b, based on the calculated amount of ball position change and a longitudinal distance on the lane 3 between the first and second sensor rows, and meanwhile a moving speed of the ball b is calculated from a difference of times when the first and second sensor rows 27*a*, 27*b* perform the detections, and from a distance between the first and second sensor rows 27*a*, 27*b*.

Then, on the basis of the recognized position and the calculated moving way and speed, a control signal is sent to the machine controller 41 so that a flow rate, corresponding to such a recognition, of compressed gas is discharged from that of nozzles 21 closer to the ball b (the first nozzle 21*a*) when the ball b passes in front of the nozzles 21 closer to the ball b, so that under the control of the machine controller 41, the compressed gas with a flow rate adjusted by the flow rate controlling mechanisms 23, 24 is supplied from the compressed-gas supply source 25 to the nozzles 21 closer to the ball b, and is discharged.

When the ball b passes in front of the nozzles 21 is computed from the calculated moving speed of the ball b. Although compressed gas is discharged from one of all the pairs of the nozzles 21: the first nozzles 21*a*, the second nozzles 21*b*, the third nozzles 21*c*, the fourth nozzles 21*d* and the fifth nozzles 21*e* because the nozzles 21 are furnished with no control valves, only compressed gas discharged from the first nozzles 21*a* strikes the ball b.

Subsequently, as a result of the rolling of the ball b, a detection signal is received from the third sensor row 27*c*, and then a widthwise position of the ball b on the lane 3 is recognized based on the signal received from the third sensor row 27*c* to determine which of the nozzles 21 included in the second nozzles 21*b* is closer to the ball b, as described in the foregoing. Additionally, a moving way is worked out by the ball positions detected in the second and third sensor rows 27*b*, 27*c*, and a moving speed of the ball b is calculated from a difference of times when the second and third sensor rows 27*b*, 27*c* perform the detection.

As in the case of the first nozzles 21, a control signal is sent, based on the recognized position, moving way worked out and calculated moving speed, to the machine controller 41 so that a flow rate, corresponding to such recognitions, of pressurized gas is discharged from that of nozzles 21 (the second nozzle 21*b*) closer to the ball b, when the ball b passes in front of the nozzles 21 closer to the ball b.

After that, likewise, whenever a detection signal is received from the sensor rows, a widthwise position of the ball b on the lane 3 is recognized, based on the signal from the fourth sensor row 27*d* (or the fifth and sixth sensor rows 27*e*, 27*f*), a moving way and speed of the ball b are calculated, and pressurized gas with a flow rate corresponding to the widthwise position, moving way and speed of the ball b is discharged from that of nozzles 21 included in the third nozzles 21*c* (or the fourth and fifth nozzles 21*d*, 21*e*), closest to the ball b.

Figure 6:
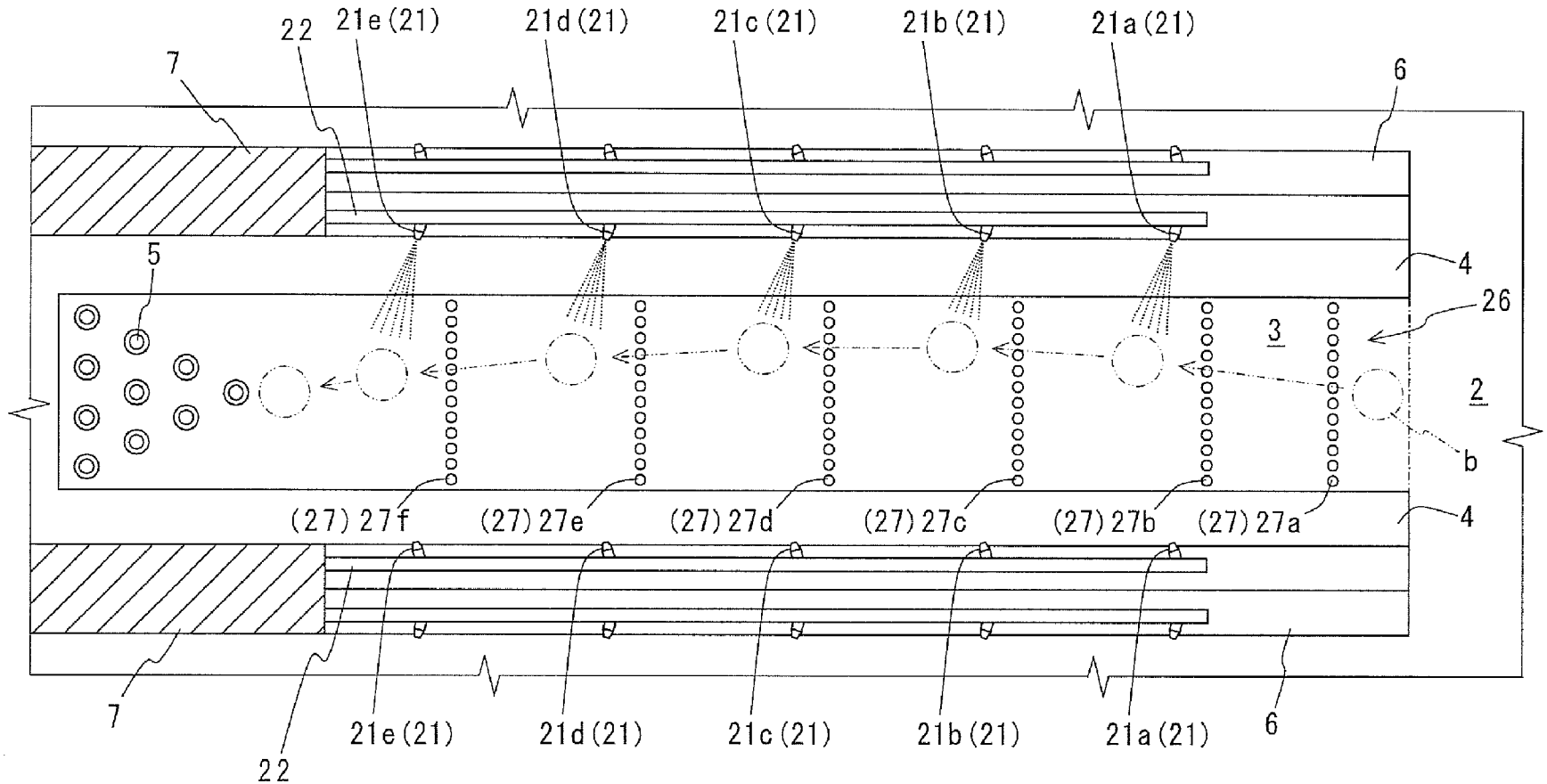
FIG. 6 is a plain view illustrating a moving path of a ball rolling down a lane.

Compressed gas is discharged from the nozzles 21 in this way, so that the compressed gas discharged from the nozzles 21 strikes the ball b from behind or right and left sides of the ball b with respect to its moving way, so that the ball b moves as illustrated in FIG. 3 and FIG. 6, while being guided so as to resultantly roll toward the center of the lane 3 (that is, so as to strike the center of the pins 5) with widthwise position on the lane 3 controlled. Moreover the moving speed of the ball b is raised.

It is to be noted that if a ball position detected by the sensor rows 27*a*, 27*b*, 27*c*, 27*d*, 27*e* and 27*f* is in the center of the lane 3, no compressed gas is required to be discharged from the nozzles 21*a*, 21*b*, 21*c*, 21*d* and 21*e*.

Next, the process on players' second attempt will be explained. The ball b is guided toward the pins 5 left upright by adjusting a flow rate of the compressed gas discharged from the nozzles 21, based on a widthwise position, moving way and moving speed of the ball b on the lane 3 as well as data on what number pins are left upright.

For example, the ball b rolling down a first edge of the lane 3 is moved toward the center of the lane 3 under the control in which compressed gas is discharged from that of nozzles 21 beside the first edge, and the ball b rolling down the center of the lane 3 is moved toward the first edge of the lane 3 under the control in which compressed gas is discharged from that of nozzle 21 beside the second edge of the lane 3, opposite to a way in which the ball b is moved, and in addition, the ball b is kept rolling with its position unchanged, under the control in which compressed gas is discharged from none of the nozzles 21.

It is to be noted that, as described in the foregoing, the position detecting mechanism 26 and the controller 40 functions as the position detecting means in the claims.

According to the bowling game system 1 of this embodiment configured as explained above, guide-executed frames in which the ball b is to be guided are determined for each player in the guide-executing processor 45, based on players' handicaps entered through the input unit 32 and stored in players' data storage 46, and after that, the players are permitted to start a bowling game.

Subsequently, the guide-executing processor 45 monitors the progress of the game for each player to distinguish whether or not a frame in which each player bowls is one of the guide executed frames, and then activates the guides 20 (the compressed-gas supply source 25 and the flow rate controlling mechanisms 23, 24) to allow the nozzles 21 to discharge compressed gas.

Therefore, even if the ball b bowled on the lane 3 rolls toward one of the gutters 4, the ball b is prevented from falling into one of the gutters 4 because the compressed gas discharged from the nozzles 21 changes the moving way of the ball b before it falling into one of the gutters 4, and meanwhile the ball b is guided so as to move toward the widthwise center of the lane 3 (so as to direct toward the center of the pins 5), striking the center of the pins 5, and guided so as to move toward pins 5 left upright after players' first attempt, striking the pins 5. Furthermore, the moving speed of the ball b is raised, so that collision energy generated when the ball b collides with pins 5 increases.

Additionally, because compressed gas is transparent and colorless, players do not recognize that the ball b is guided by compressed gas, so that they are made to believe that they could control the ball b to roll it down at the pins 5 in their own, so that the pins 5 are knocked down.

In this way, according to the bowling game system 1 of the present invention, as well as guiding the ball b, the compressed gas discharged from the nozzles 21 raises the moving speed of the ball b to increase the collision energy generated when the ball b collides with the pins 5, so that children unable to control the direction of rolling a ball or bowl at a high speed can always knock down many of the pins 5, and sometimes get strikes and spares. Therefore, the children are made to believe that they have made progress in bowling, and are allowed to get high score even if they bowl on the same lane with non-children players, so that the children are able to enjoy household bowling outings by competing with each other as players on the same level as non-children players without losing interest in games.

Furthermore, in which frames the guides 20 is activated is determined on the basis of handicaps determined depending on players' skill and the guides 20 are activated only in the determined frames, so that players' real ability is handicapped to make the players apparently equal in their skill, allowing them to enjoy a so-called fight with real swords during the game.

In a bowling game, the score rises depending on how many times players get a strike consecutively and how many pins they knock down on their first attempt subsequent to the frame in which they get a spare, as well as on the total number of pins they knock down in each frame. Therefore, even if the players get a strike or a spare owing to the guides 20 in the guide frames, their scores do not always rise depending on the results (strike, spare or open frame) prior to and subsequent to the guide frames. That is, even if the ball b is guided, players' score has variability, which keeps a bowling game enjoyable to prevent the players from losing interest in the game.

Besides, varying a flow rate of the compressed gas discharged from the nozzles 21, depending on a widthwise position, moving way and speed of the ball b on the lane 3 makes it possible to efficaciously guide the ball b and raise the moving speed of the ball b.

While one embodiment of the present invention has been explained in the foregoing, specific modes by which the present invention can be adopted are not in any way limited to the above example.

Although an example of the configuration in which the ball b is guided so as to roll toward the pins 5 is explained in the foregoing, it is not limited to this example, so that another configuration can be made, in which players roll the ball b down the lane 3 with a constant flow rate of compressed gas being discharged from all of the nozzles 21.

Such a configuration, in which the ball b is not guided, but at least prevented from slipping into one of the gutters 4, enables even children unable to control the direction of rolling a ball to always knock down some of the pins 5 and keep on scoring. Additionally, it is the same advantage with the example in the foregoing that the children are made to believe that they improve themselves in bowling, so that they are able to enjoy household bowling outings without losing interest in games.

The compressed-gas supply source 25 and the flow rate controlling mechanisms 23, 24 may be controlled via the machine controller 41 so that compressed gas is discharged for a fixed period of time from the nozzles 21*a*, 21*b*, 21*c*, 21*d* and 21*e* corresponding to sensor rows 27*b*, 27*c*, 27*d*, 27*e* and 27*f* respectively, when the guide-executing processor 45, which confirms whether or not the ball b is in one of predetermined regions on the edges of the lane 3 (whether or not the ball b is rolling in one of the regions on the edges of the lane 3), determines that the ball b is in position.

This prevents the ball b rolling down the center of the lane 3 from being inexpediently guided toward one of the gutters 4 by the compressed gas discharged from the nozzles 21.

In this case, for confirming whether or not the ball b is in one of the regions on the edges of the lane 3, the guide-executing processor 45 may further confirm beside where of the gutters 4 the ball b is in position so that compressed gas is discharged that of nozzles 21 beside one of gutters 4, along where the ball b is confirmed to be in position.

Also feasible is a configuration in which the third, fourth, fifth and sixth sensor rows 27*c*, 27*d*, 27*e*, 27*f* are omitted, and the guide-executing processor 45 calculates a moving way and speed of the ball b from a ball b position detected by the first and second sensor rows 27*a*, 27*b* to predict a moving path of the ball b, based on the position and moving way and speed of the ball b, and then determines, based on the predicted moving path, which of the nozzles 21 is to discharge compressed gas in order to prevent the ball b from moving into one of the predetermined regions on the edges of the lane 3, before the compressed-gas supply source 25 and the flow rate controlling mechanisms 23, 24 are controlled via the machine controller 41 based on the moving speed of the ball b so that compressed gas is supplied to that of nozzle 21 that has been determined, and is discharged for a fixed duration, timed to when the ball b passes in front of the determined nozzle 21.

For example, given that the guide-executing processor 45 confirms, based on the predicted moving path, that the ball b enters one of the regions on the edges of the lane 3 in a vicinity of the nozzles 21*c* disposed third from the approach 2, the compressed gas is discharged from the third nozzles 21*c*, and if needed, from the second nozzles 21*b* and the fourth nozzles 21*d*, to prevent the ball b from entering one of the regions on the edges of the lane 3.

Additionally, another configuration may be also taken, in which the guide-executing processor 45 determines which of the nozzles 21 is to discharge compressed gas and how much flow rate of compressed gas is to be discharged from that of nozzle 21 that has been determined in order to guide the ball b toward the pins 5, and a properly adjusted flow rate of compressed gas is supplied to the determined nozzle 21 so that the determined flow rate of compressed gas is discharged from the determined nozzles 21, timed to when the ball b passes in front of the determined nozzles 21.

Figure 7:
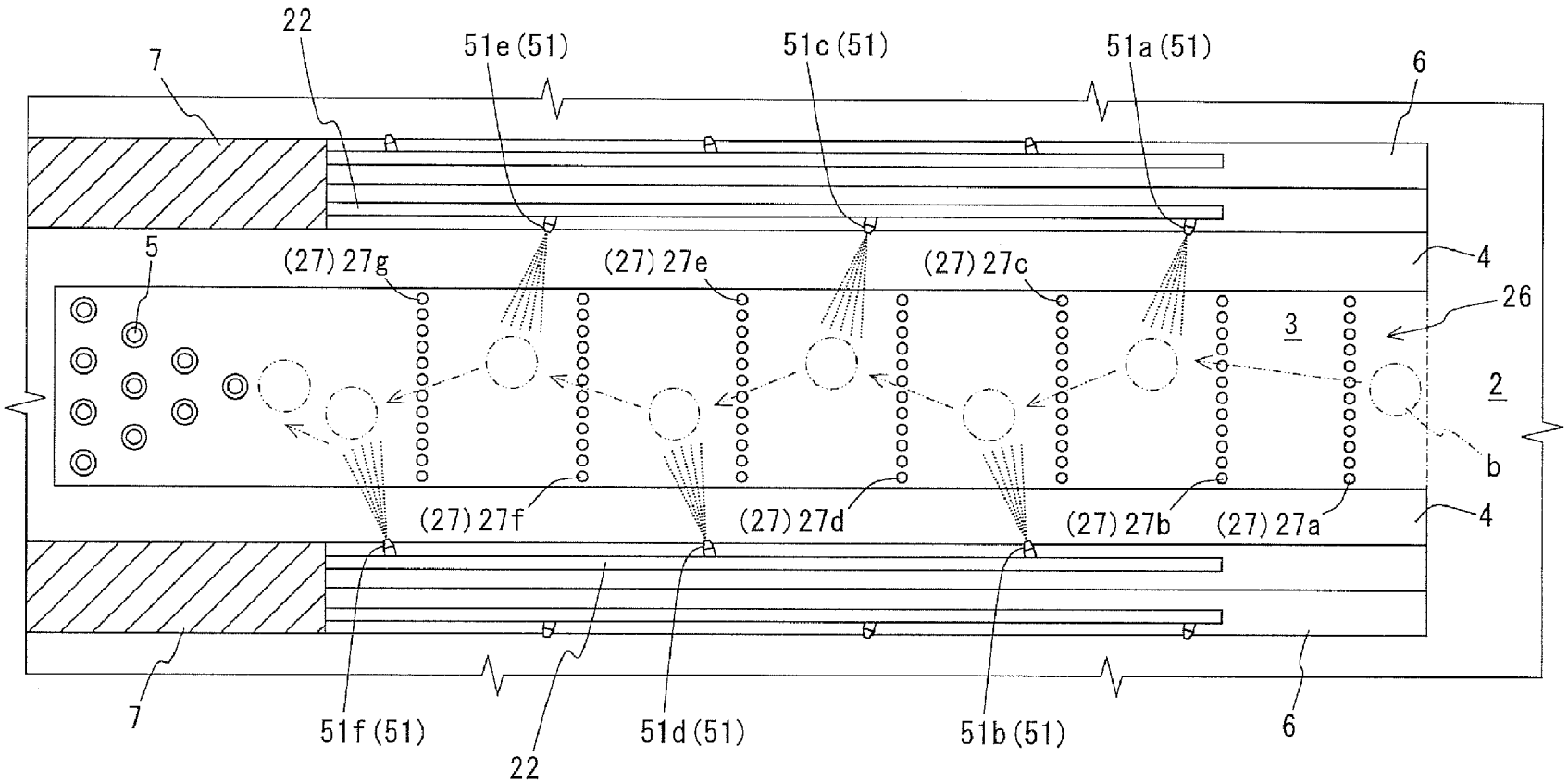
FIG. 7 is a plain view illustrating an outlined configuration of the bowling game system involving a second embodiment of the present invention.

In the example above, the nozzles 21 are disposed facing each other across the lane 3 and the gutters 4, 4 as a pair, with a plurality of such pairs being disposed paralleling the lane 3, while nozzles 51 (the first, second, third, fourth, fifth and sixth nozzles 51*a*, 51*b*, 51*c*, 51*d*, 51*e* 51*f*) may be disposed paralleling the lane 3 in a configuration staggered on either side, as illustrated in FIG. 7.

Figure 8:
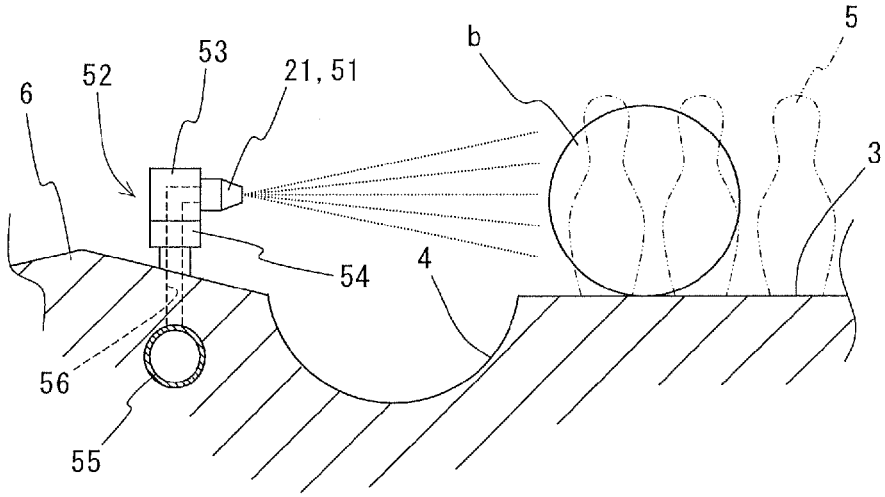
FIG. 8 is a cross-sectional view illustrating an outlined configuration of nozzles involving the second embodiment of the present invention.
Figure 9:
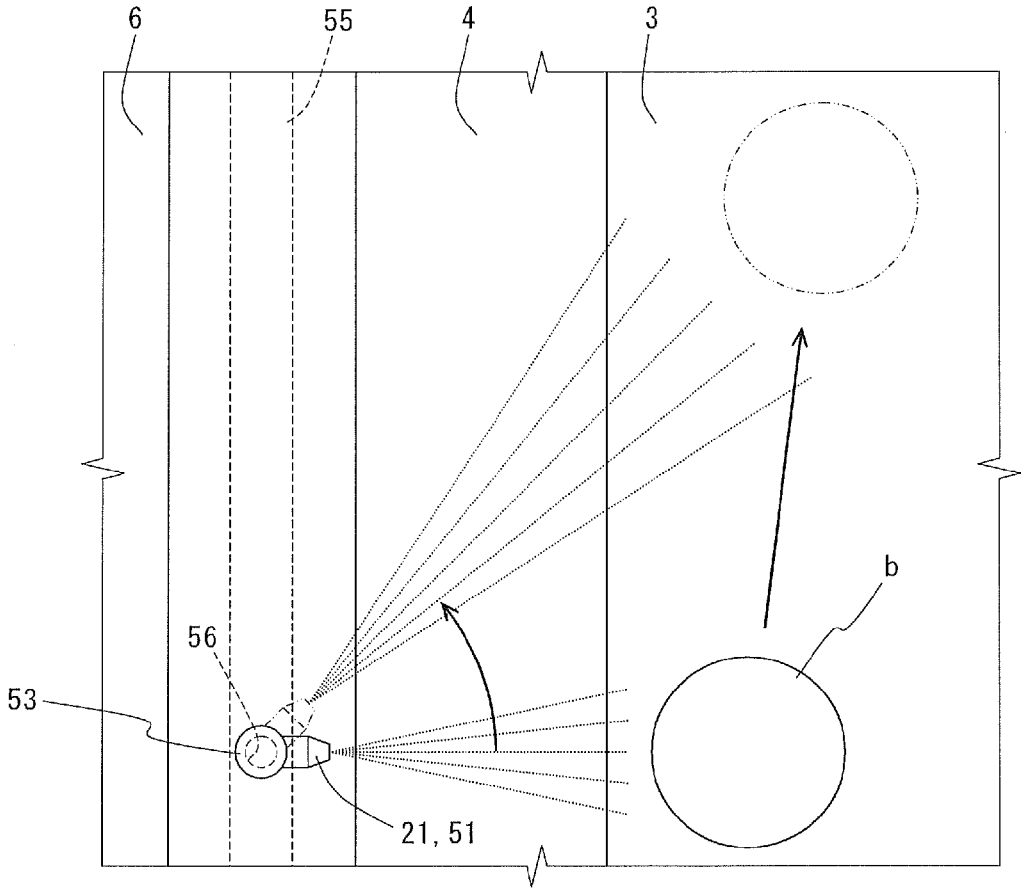
FIG. 9 is a plain view illustrating nozzles of FIG. 8.

On the other hand, as illustrated in FIG. 8 and FIG. 9, there may be a configuration in which the nozzles 21, 51 pivot horizontally on pivoting mechanisms 52. The pivoting mechanisms 52 are provided with a first member 53 retaining nozzles 21, 51, a second member 54 planted on the separators 6 and horizontally retaining pivotally the first member 53 and a drive motor (not illustrated) allowing the first member 53 to rotate counterclockwise with respect to the second member 54. Moreover, a supply pipe 55 for feeding compressed gas is embedded in the separator 6, and compressed gas is supplied through the supply pipe to the nozzles 21, 51 via the a supply path 56 formed as appropriate.

In addition, applicable is a configuration in which the guide-executing processor 45 controls the activation of the drive motor (not illustrated) via the machine controlling section 41 based on the basis of a widthwise position of the ball b, detected by sensor rows 27*a*, 27*b*, 27*c*, 27*d*, 27*e*, 27*f* (and 27*g*), on the lane 3 and a moving way and speed of the ball b, calculated from the position of the ball b so that an orientation of discharging compressed gas is directed diagonally toward the pins 5 by rotating the first member 53 horizontally with respect to the second member 54 at a speed that depends on the moving speed of the ball b to allow compressed gas to continuously strike the ball b passing in front of the nozzles 21, 51.

Horizontally pivoting the nozzles 21, 51 in this way allows compressed gas discharged from the nozzles 21, 51 toward the ball b to continuously strike the ball b for a longer period of time, so that the ball b is guided efficaciously and its moving speed is raised.

Figure 10:
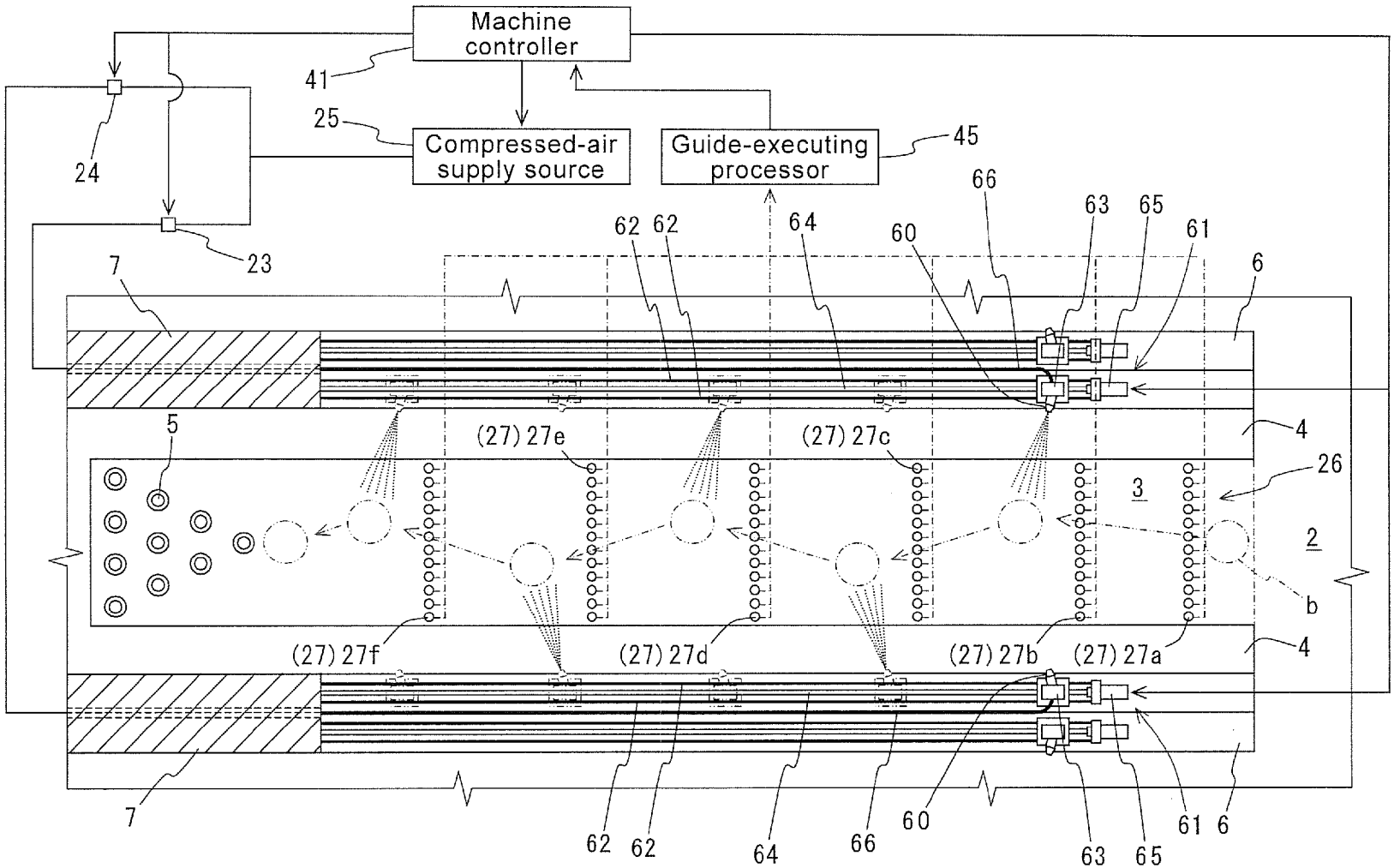
FIG. 10 is a plain view illustrating an outlined configuration, which is partially represented by block diagram of the bowling game system involving the second embodiment of the present invention.

Furthermore, as illustrated in FIG. 10, a configuration in which nozzles 60 disposed facing each other across the lane 3 and the gutters 4, 4 is shifted along the lane 3 by a drive mechanism 61 may be taken. The drive mechanism 61 is furnished with guide rails 62 laid on the separations 6 along the lane 3, shifting members 63 for retaining the nozzles 60, engaged to the guide rails 62 and configured slidably along the guide rails 62, ball screws 64 disposed paralleling the guide rails 62, over the separations 6 so as to axially rotate, nuts (not illustrated) screwed onto the ball screws 64 to anchor them to the shifting members 63, and a drive motor 65 for axially rotating the ball screws 64, so that rotating the screws 64 on the drive motor 65 allows the shifting members 63 to slide along the guide rails 62. Additionally, the nozzles 60 are supplied with compressed gas from the compressed-gas supply source 25 via supply members 66 configured with a flexible tube.

In this configuration, the guide-executing processor 45 calculates a moving speed of the ball b from a widthwise position of the ball b, detected by the sensor rows 27*a*, 27*b*, 27*c*, 27*d*, 27*e* and 27*f*, on the lane 3, and controls, based on the calculated speed, activation of the drive motor 65 via the machine controller 41 to slide the moving parts from the vicinity to the approach 2 toward the pins 5 at a speed corresponding to the calculated speed in synchronization with the movement of the ball b so that the ball b is in front of the nozzles 60.

Moreover, whenever the sensor rows 27*a*, 27*b*, 27*c*, 27*d*, 27*e* and 27*f* detect a widthwise position of the ball b on the lane 3, a flow rate of the compressed gas discharged from, and the sliding speed of, the nozzles 60 are adjusted depending on the widthwise position, moving way and moving speed of the ball b.

In this way, sliding the nozzles 60 along the lane 3 allows compressed gas to be discharged from the nozzles 60 any time as needed, so that the ball b is guided more efficaciously and its moving speed is raised.

Also in this case, the nozzles 60 may be slid on the driving mechanism 61 toward the pins 5 with the determined flow rate of compressed gas being discharged from the nozzles 60 continuously or continually, which at least prevents the ball b rolling down the lane 3 from falling into one of the gutters 4. It is to be noted that continuously discharging compressed gas is preferable because continuous discharge prevents the ball b from falling into one of the gutters 4 more securely than continue discharge.

Besides, the guide-executing processor 45 may recognize whether or not the ball b is in one of the predetermined regions on the edges of the lane 3, based on a position of the ball b, sequentially detected by the sensor rows 27*a*, 27*b*, 27*c*, 27*d*, 27*e* and 27*f* to control the compressed-gas supply source 25 and the flow rate controlling mechanisms 23, 24 via the machine controller 41 so that compressed gas is discharged from the nozzles 60 for a fixed period of time when the ball b is determined to be in position.

In this case, a configuration in which the guide-executing processor 45 recognizes beside which of gutters 4 the ball b is in position, and then compressed gas is discharged only from that of nozzle 60 along that of gutter 4 beside where the ball b is recognized to be in position may be also taken.

Also feasible is a configuration in which the third, fourth, fifth and sixth sensor rows 27*c*, 27*d*, 27*e*, 27*f* of the position detecting mechanism 26 are omitted, and the guide-executing processor 45 calculates a moving ways and speed of the ball b from a ball b position detected by the first and second sensor rows 27*a*, 27*b* to predict a moving path of the ball b on the basis of the ball b position, moving way and speed, determines along which of an interval with respect to the orientation in which the nozzles 60 slide compressed gas is to be discharged and which of the nozzles 60 is to discharges compressed gas in order to prevent the ball b from moving into one of the predetermined regions on the edged of the lane 3, and controls the compressed-gas supply source 25 and flow rate controlling mechanisms 23, 24 via the machine controller 41 so that the compressed gas is supplied to that of nozzle 60 that has been determined, and is discharged while the determined nozzle 60 slides in the determined interval.

Moreover, the guide-executing processor 45 may be configured so as to determine, based on the predicted moving path, along which of an interval with respect to an orientation in which the nozzles 60 slide compressed gas is to be discharged, which of the nozzles 60 is to discharge compressed gas and how much flow rate of compressed gas is discharged from that of nozzle 60 that has been determined in order to guide the ball b toward a predetermined part of the pins 5, allowing compressed gas to be supplied to the determined nozzle 60 and be discharged while the determined nozzle 60 slides in the determined interval.

A configuration is not limited to this example in which the compressed gas is discharged from the nozzles 21, 51 and 60 diagonally toward the pins 5, so that a configuration in which compressed gas is discharged perpendicularly with respect to the lane 3 may be taken. In such a configuration, however, the compressed gas cannot be discharged at the ball b from behind with respect to the moving way, so that the moving speed of the ball b is not raised.

Figure 11:
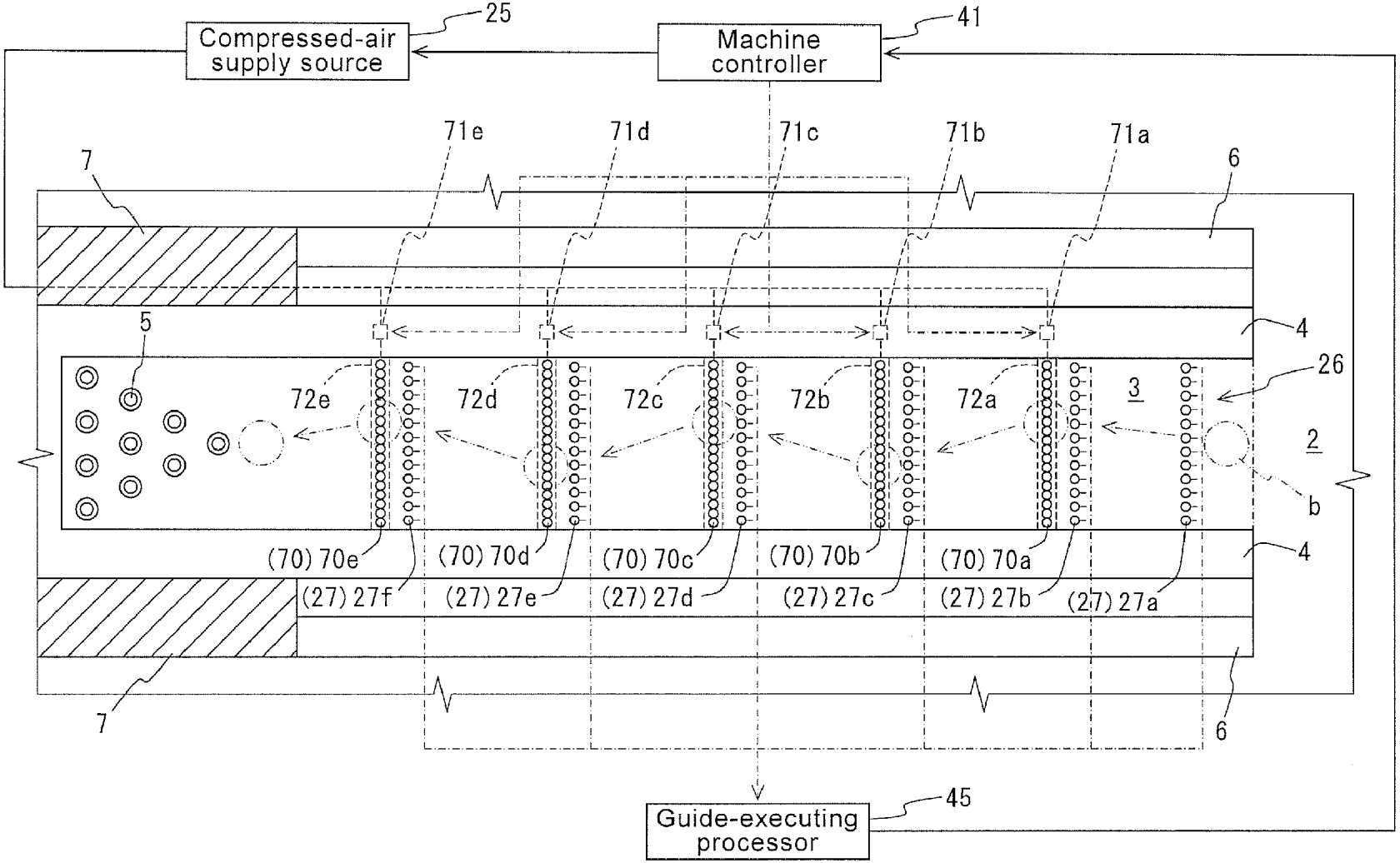
FIG. 11 is a plain view illustrating an outlined configuration, which is partially represented by a block diagram, of the bowling game system involving the second embodiment of the present invention.
Figure 12:
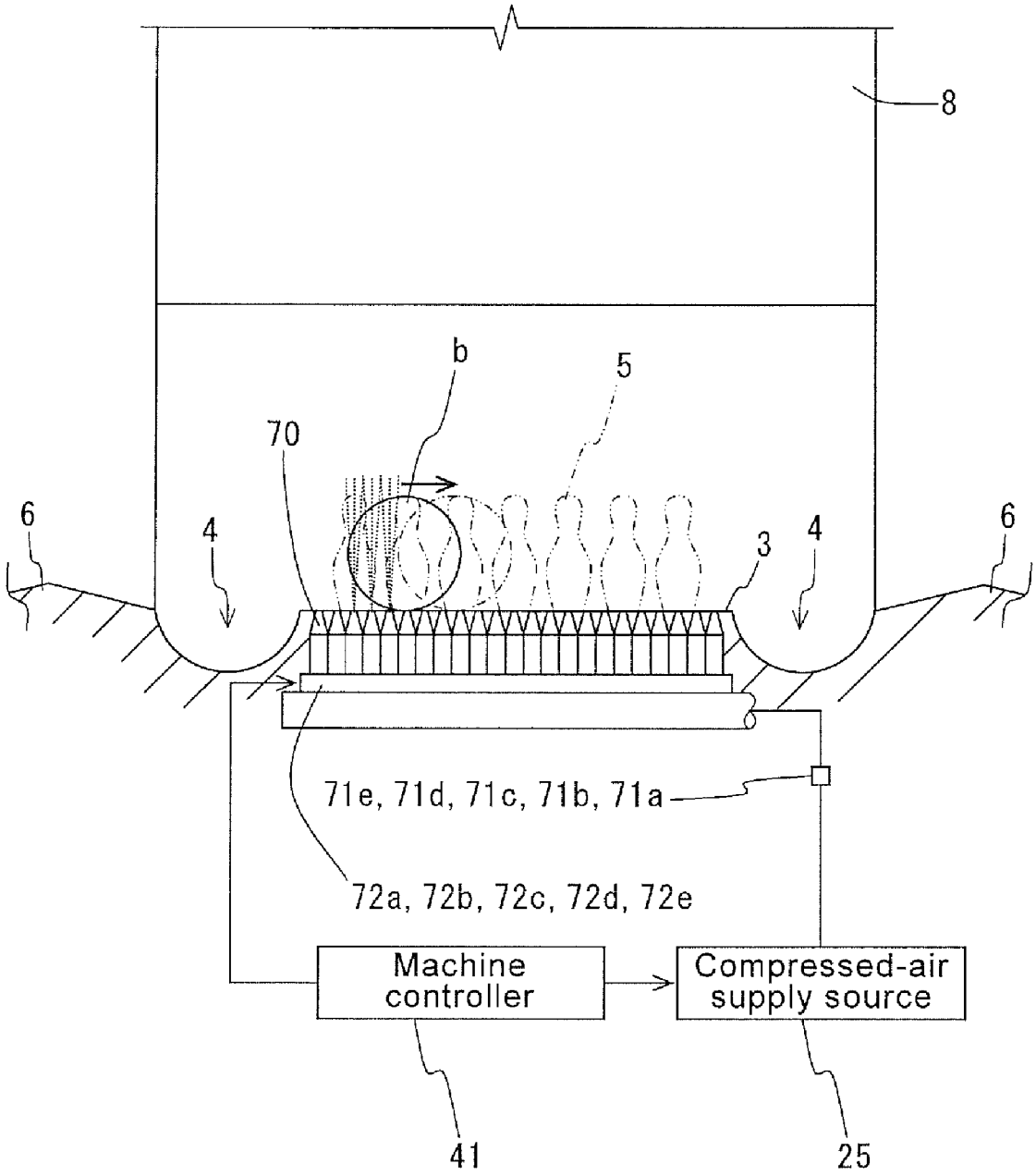
FIG. 12 is a sectional side view illustrating the bowling game system of FIG. 11.

In addition, as illustrated in FIG. 11 and FIG. 12, a plurality of nozzles 70, which are embedded in the lane 3 so as to discharge compressed gas supplied from the compressed-gas supply source 25 upwards from the upper surface of the lane 3, may be disposed widthwise in the lane 3.

The plurality of the nozzles 70 are arranged perpendicular to the lane 3 as a set, with a plurality of the sets being disposed paralleling the lane 3, and these sets of nozzles 70 are called the first, second, third, fourth and fifth nozzle rows 70*a*, 70*b*, 70*c*, 70*d*, 70*e* from the approach 2, corresponding to the second, third, fourth, and fifth sensor rows 27*b*, 27*c*, 27*d*, 27*e*, 57*f* respectively.

The compressed-gas supply source 25 is connected to the nozzle rows 70*a*, 70*b*, 70*c*, 70*d* and 70*e* via flow rate controlling mechanisms 71*a*, 71*b*, 71*c*, 71*d* and 71*e*, and further connected to that of nozzles 70 that compose the nozzle rows 70*a*, 70*b*, 70*c*, 70*d* and 70*e* via flow rate controlling mechanisms 72*a*, 72*b*0 72*c*, 72*d* and 72*e* so compressed gas whose flow rate is adjusted by the flow rate controlling mechanisms 71*a*, 71*b*, 71*c*, 71*e*, 72*a*, 72b, 72*c*, 72*d* and 72*e* is supplied to, and discharged from the nozzles 70.

The guide-executing processor 45 controls the activation of the compressed-gas supply source 25 and the flow rate controlling mechanisms 71*a*, 71*b*, 71*c*, 71*d*, 71*e*, 72*a*, 72*b*, 72*c*, 72*d* and 72*e* via the machine controller 41, based on a widthwise position of the ball b on the lane 3, detected by the sensor rows 27*b*, 27*c*, 27*d*, 27*e* and 27*f* to allow the nozzles 70 corresponding to the detected position of the ball b to discharge compressed gas. As described in the foregoing, the flow rate of compressed gas is controlled depending on the ball b position, moving way and speed.

For example, when the ball b rolling down a first edge of the lane 3 is moved toward the center of the lane 3, it is recognized from the detected ball position which of the nozzles 70 lies under the ball b surface closer to the first edge with respect to a plumb plane paralleling the lane 3 and passing the center of the ball b to allow compressed gas to be discharged from that of nozzle 70 that has been recognized, and when the ball b rolling down the center of the lane 3 is moved toward the first edge of the lane 3, it is recognized from the detected ball position which of the nozzles 70 lies under the ball b surface closer to a second edge opposite to the first edge, across the plumb plane to allow compressed gas to be discharged from that of nozzle 70 that has been recognized.

In this case, also feasible is a configuration in which the third, fourth, fifth and sixth sensor rows 27*c*, 27*d*, 27*e*, 27*f* of the position detecting mechanism 26 are omitted, and the guide-executing processor 45 calculates a moving way and speed of the ball b from the ball b position detected by the first and second sensor rows 27*a*, 27*b* to predict a moving path of the ball b from the detected ball b position, moving way and speed, determines based on the predicted moving path, which of the nozzles 70 is to discharge compressed gas and how much flow rate of compressed gas is to be discharged from that of nozzle 70 that has been determined in order to guide the ball b toward a predetermined part of the pins 5, and allows the appropriately adjusted flow rate of compressed gas to be supplied to the determined nozzle 70 so that the determined flow rate of compressed gas is discharged, timed to when the ball b passes on the determined nozzle 70.

Additionally, if another feasible configuration, in which that of nozzles 70 that compose the nozzle rows 70*a*, 70*b*, 70*c*, 70*d*, 70*e* are omitted except for that of nozzles 70 that are disposed on the edges of the lane 3, with a determined flow rate of compressed gas being discharged from that of nozzles 70 on the edges of the lane 3, is taken, the ball b rolling down the lane 3 is prevented at least from falling into one of the gutters 4.

In such a configuration, the guide-executing processor 45 may recognize based on a position of the ball b, detected any time by the sensor rows 27*a*, 27*b*, 27*c*, 27*d*, 27*e* and 27*f*, whether or not the ball b is in one of the predetermined regions on the edges of the lane 3 to control the compressed-gas supply source 25 and the flow rate controlling mechanisms 23, 24 via the machine controller 41 so that compressed gas is discharged from the nozzle rows 70*a*, 70*b*, 70*c*, 70*d* and 70*e* corresponding to the sensor rows 27*b*, 27*c*, 27*d*, 27*e* and 27*f* for a fixed period of time, when the ball b is determined to be in position.

On the other hand, the guide-executing processor 45 may further recognize along which of gutters 4 the ball b is in position to allow compressed gas to be discharged only from that of nozzles 70 along that of gutter 4 beside where the ball b is recognized to be in position.

Additionally, acceptable is a configuration in which the third, fourth, fifth, and sixth sensor rows 27*c*, 27*d*, 27*e*, 27*f* of the position detecting mechanism 26 are omitted, and the guide-executing processor 45 calculates a moving way and moving speed of the ball b from a position of the ball b, detected by the first and second sensor rows 27*a*, 27*b* to predict a moving path of the ball b, based on the ball b position, moving way and speed, determines from the predicted moving path, which of nozzles 70 is to discharge compressed gas in order to prevent the ball b from moving into one of the predetermined regions on the edges of the lane 3, and subsequently controls the compressed-gas supply source 25 and the flow rate controlling mechanisms 23, 24 via the machine controller 41 so that compressed gas is supplied to that of nozzle 70 that has been determined, and is discharged during a fixed duration, timed to when the ball b passes on the determined nozzle 70.

Furthermore, the nozzles 70 disposed widthwise on the edges of the lane 3 may be arranged in a staggered configuration longitudinally on either side of the lane 3.

While a configuration in which a flow rate of the compressed gas discharged from the nozzles 21, 51, 60, 70 is adjusted based on the widthwise position, moving way and speed of the ball b on the lane 3 is described in the above example, the configuration is not limited to the example, so that a pressure of compressed gas discharged from the nozzles 21, 51, 60 and 70 may be adjusted by controlling a pressure of the compressed gas supplied from the compressed-gas supply source 25. And also acceptable is a configuration in which both of flow rate and pressure of the compressed gas to be discharged are controlled.

In addition, a flow rate and/or pressure of the compressed gas to be discharged may be controlled depending on only a widthwise position of the ball b on the lane 3 or on a position, moving way and speed of the ball b. The moving way of the ball b is an example, so that it is not limited to the example.

Also another configuration may be taken, in which data on the mass of the ball b players use is stored in the player data storage 46, and the guide-executing processor 45 recognizes the mass of ball b, stored in the player data storage 46 to determine a flow rate and pressure of the compressed gas discharged from the nozzles 21, 51, 60 and 70, and to predict a moving path of the ball b.

As a sensor for detecting a position, speed and moving way of the ball b, any sensor may be adapted if it can detect the position, speed and moving way.

INDUSTRIAL APPLICABILITY

As described in the foregoing, the present invention is preferably adapted to the bowling game system for a game in which a ball is rolled down the lane to enjoy knocking down the pins arranged on the lane.

The embodiments and implementations that have been disclosed here are illustrative by nature are should not be regarded as limiting. The scope of the invention is defined by its claims rather than the foregoing description, and should be understood to include the features of the claims of the invention and equivalents thereof, in addition to all changes falling within the scope of the claims.

The invention claimed is:

1. A bowling game system furnished with an approach as an area where a player bowls a ball, a lane extending from the approach and on which a bowling ball bowled by a player rolls, a plurality of bowling pins arranged and placed on an end of the lane opposite the approach, and trough-like gutters provided paralleling both sides of the lane to receive bowling balls slipping off the lane; the bowling game system characterized in being further provided with:

a discharging mechanism for discharging, in a plurality of locations paralleling said lane, pressurized gas at a ball rolling down the lane so that the ball is prevented from falling into the gutters by the discharged pressurized gas; and a gas supplying means for supplying pressurized gas to, so that it will be discharged from, said discharging mechanism.

2. The bowling game system of claim 1, characterized in that:

said discharging mechanism is configured with a plurality of discharging means for discharging the pressurized gas directed toward the lane, the discharging means being arranged longitudinally on the outer sides of said lane; and said gas supplying means is configured so as to feed the pressurized gas to each said discharging means.

3. The bowling game system of claim 2, characterized in being further provided with a control means for determining, based on handicaps defined in accordance with a players' skill, in which frames during a game said gas supplying means is to be activated, and for subsequently monitoring the progress of the game to supply pressurized gas from said gas supplying means to said discharging means when the game has reached an applicable frame.

4. The bowling game system of claim 2, characterized in being further provided with:

position detecting means for detecting ball position in the lane widthwise, in position-detecting locations defined respectively corresponding to, and nearer to the approach end than, said discharging means; and a control means for confirming, based on ball position in the position-detecting locations successively detected by said position detecting means, whether or not a ball is positioned within preestablished lane-bordering regions along where said discharging means corresponding to the position-detecting locations are arranged, and when a ball is determined to be so positioned, for controlling said gas supplying means so as to feed the pressurized gas to said discharging means so as to cause the pressurized gas to be discharged for a fixed duration.

5. The bowling game system of claim 4, characterized in that said control means is configured to determine, based on handicaps defined in accordance with a players' skill, in which frames during a game said gas supplying means is to be activated, and to then monitor the progress of the game to supply pressurized gas from said gas supplying means to said discharging means when the game has reached an applicable frame.

6. The bowling game system of claim 2, characterized in being further provided with:

detecting means, more toward the approach-area end of the lane than that of said discharging means nearest the approach area, for detecting ball position in the lane widthwise, ball moving speed, and ball travel direction; and a control means for predicting, based on the ball position and ball travel direction detected by said detecting means, ball travel path, and based on the predicted travel path, in order that a ball not travel into preestablished lane-bordering regions, deciding upon which said discharging means is to discharge pressurized gas, and controlling said gas supplying means so as supply to the decided-upon discharging means pressurized gas timed, based on the ball speed detected by said detecting means, to when the ball passes a position ahead of that discharging means in its discharging direction, and cause the pressurized gas to be discharged for a fixed duration.

7. The bowling game system of claim 6, characterized in that said control means is configured to determine, based on handicaps defined in accordance with a players' skill, in which frames during a game said gas supplying means is to be activated, and to then monitor the progress of the game to supply pressurized gas from said gas supplying means to said discharging means when the game has reached an applicable frame.

8. The bowling game system of claim 2, characterized in being further provided with:

position detecting means for detecting the widthwise position of a ball on the lane, in position-detecting locations defined respectively corresponding to, and nearer to the approach end than, said discharging means; and a control means for controlling said gas supplying means so as to guide the ball toward a predetermined part of the bowling pins, by adjusting, in accordance with ball position in the position-detecting locations successively detected by said position detecting means, supply flow rate and/or supply pressure of the pressurized gas fed to said discharge means corresponding to the position-detecting locations to vary the flow rate and/or pressure of the discharge from said discharging means.

9. The bowling game system of claim 8, characterized in that said control means is configured to determine, based on handicaps defined in accordance with a players' skill, in which frames during a game said gas supplying means is to be activated, and to then monitor the progress of the game to supply pressurized gas from said gas supplying means to said discharging means when the game has reached an applicable frame.

10. The bowling game system of claim 2, characterized in being further provided with:

detecting means, more toward the approach-area end of the lane than that of said discharging means nearest the approach area, for detecting in the lane widthwise ball position, ball moving speed, and ball travel direction; and a control means for predicting, based on the ball position and ball travel direction detected by said detecting means, ball travel path, and based on the predicted travel path, in order to guide the ball toward a predetermined part of the bowling pins, deciding upon which said discharging means is to discharge pressurized gas, and the discharge flow rate and/or discharge pressure at which to discharge from that discharging means, and controlling said gas supplying means so as supply to the decided-upon discharging means pressurized gas at a supply flow rate and/or supply pressure in accordance with the decided-upon discharge flow rate and/or discharge pressure, and timed, based on the ball speed detected by said detecting means, to when the ball passes a position ahead of that discharging means in its discharging direction.

11. The bowling game system of claim 10, characterized in that said control means is configured to determine, based on handicaps defined in accordance with a players' skill, in which frames during a game said gas supplying means is to be activated, and to then monitor the progress of the game to supply pressurized gas from said gas supplying means to said discharging means when the game has reached an applicable frame.

12. The bowling game system of claim 1, characterized in that:

said discharging mechanism is configured with two discharging means for discharging pressurized gas directed toward the lane, the discharging means being provided facing each other on either outer side of the lane, and a drive means for supporting said discharge means and shifting each along the lane lengthwise; and said gas supplying means is configured so as to feed the pressurized gas to each said discharge means; therein characterized in being further provided with:

speed detecting means, more toward the approach-area end than the limit to which said discharging means can be shifted, for detecting the traveling speed of the ball; and a control means for controlling said drive means to shift said discharging means, keeping pace with the ball, from along the approach area toward the bowling pins at a speed corresponding to the ball speed detected by said speed detecting means, and so that the ball is positioned ahead of said discharging means in its discharging direction, and for controlling said gas supplying means to feed pressurized gas to each said discharging means while said discharging means are traveling, and so as to discharge the pressurized gas continuously or intermittently.

13. The bowling game system of claim 12, characterized in that said control means is configured to determine, based on handicaps defined in accordance with a players' skill, in which frames during a game said gas supplying means is to be activated, and to then monitor the progress of the game to supply pressurized gas from said gas supplying means to said discharging means when the game has reached an applicable frame.

14. The bowling game system of claim 12, further provided with:

position detecting means for detecting the widthwise position of a ball on the lane, in a plurality of position-detecting locations defined along the lane lengthwise; therein characterized in that:

said control means is configured to confirm, based on ball position in the position-detecting locations successively detected by said position detecting means, whether or not a ball is positioned within preestablished border regions on either side of the lane, and when a ball is determined to be so positioned, to control said gas supplying means so as to feed the pressurized gas to at least that discharging means along the lane-bordering region where the ball is located, and cause the pressurized gas to be discharged for a fixed duration.

15. The bowling game system of claim 14, characterized in that said control means is configured to determine, based on handicaps defined in accordance with a players' skill, in which frames during a game said gas supplying means is to be activated, and to then monitor the progress of the game to supply pressurized gas from said gas supplying means to said discharging means when the game has reached an applicable frame.

16. The bowling game system of claim 12, further provided with:

detecting means, more toward the approach-area end than the limit to which said discharging means can be shifted, for detecting ball position in the lane widthwise and ball travel direction; therein characterized in that said control means is configured to predict, based on the ball position and ball travel direction detected by said detecting means, ball travel path, and based on the predicted travel path, in order that a ball not travel into preestablished lane-bordering regions, to decide upon which said discharging means is to discharge the pressurized gas and to decide upon the interval, in the direction in which each discharge means travels, along which pressurized gas is to be discharged, and to control said gas supplying means so as supply pressurized gas to, so that it will be discharged from, the decided-upon discharging means, while that discharging means passes through the decided-upon interval.

17. The bowling game system of claim 16, characterized in that said control means is configured to determine, based on handicaps defined in accordance with a players' skill, in which frames during a game said gas supplying means is to be activated, and to then monitor the progress of the game to supply pressurized gas from said gas supplying means to said discharging means when the game has reached an applicable frame.

18. The bowling game system of claim 12, further provided with:

position detecting means for detecting the widthwise position of a ball on the lane, in a plurality of position-detecting locations defined along the lane lengthwise; therein characterized in that:

said control means is configured to control said gas supplying means so as to guide the ball toward a predetermined part of the bowling pins, by adjusting, in accordance with ball position in the position-detecting locations successively detected by said position detecting means, supply flow rate and/or supply pressure of the pressurized gas fed to each discharge means to vary the discharge flow rate and/or discharge pressure of the pressurized gas discharged from each discharging means.

19. The bowling game system of claim 18, characterized in that said control means is configured to determine, based on handicaps defined in accordance with a players' skill, in which frames during a game said gas supplying means is to be activated, and to then monitor the progress of the game to supply pressurized gas from said gas supplying means to said discharging means when the game has reached an applicable frame.

20. The bowling game system of claim 12, further provided with:

detecting means, more toward the approach-area end than the limit to which said discharging means can be shifted, for detecting ball position in the lane widthwise and ball travel direction; therein characterized in that said control means is configured to predict, based on the ball position and ball travel direction detected by said detecting means, ball travel path, and based on the predicted travel path, in order to guide the ball toward a predetermined part of the bowling pins, to decide upon which said discharging means is to discharge the pressurized gas, decide upon the interval, in the direction in which said discharge means travel, along which pressurized gas is to be discharged, and decide upon the discharge flow rate and/or discharge pressure at which to discharge from that discharging means, and to control said gas supplying means so as supply pressurized gas to the decided-upon discharging means, at a supply flow rate and/or supply pressure in accordance with the decided-upon discharge flow rate and/or discharge pressure, while that discharging means passes through the decided-upon interval.

21. The bowling game system of claim 20, characterized in that said control means is configured to determine, based on handicaps defined in accordance with a players' skill, in which frames during a game said gas supplying means is to be activated, and to then monitor the progress of the game to supply pressurized gas from said gas supplying means to said discharging means when the game has reached an applicable frame.

22. The bowling game system of claim 1, characterized in that:

said discharging mechanism is configured from a plurality of discharging means for discharging the pressurized gas directed upwards, the discharging means being arranged longitudinally along, and embedded in, either side of said lane; and said gas supplying means is configured so as to feed the pressurized gas to each discharging means.

23. The bowling game system of claim 22, characterized in being further provided with a control means for determining, based on handicaps defined in accordance with a players' skill, in which frames during a game said gas supplying means is to be activated, and for subsequently monitoring the progress of the game to supply pressurized gas from said gas supplying means to said discharging means when the game has reached an applicable frame.

24. The bowling game system of claim 22, characterized in being further provided with:

position detecting means for detecting ball position in the lane widthwise, in position-detecting locations defined respectively corresponding to, and nearer to the approach end than, said discharging means; and a control means for confirming, based on ball position in the position-detecting locations successively detected by said position detecting means, whether or not a ball is positioned within preestablished lane-bordering regions along where said discharging means corresponding to the position-detecting locations are arranged, and when a ball is determined to be so positioned, for controlling said gas supplying means so as to feed the pressurized gas to said discharging means so as to cause the pressurized gas to be discharged for a fixed duration.

25. The bowling game system of claim 24, characterized in that said control means is configured to determine, based on handicaps defined in accordance with a players' skill, in which frames during a game said gas supplying means is to be activated, and to then monitor the progress of the game to supply pressurized gas from said gas supplying means to said discharging means when the game has reached an applicable frame.

26. The bowling game system of claim 22, characterized in being further provided with:

detecting means, more toward the approach-area end of the lane than that of said discharging means nearest the approach area, for detecting ball position in the lane widthwise, ball moving speed, and ball travel direction; and a control means for predicting, based on the ball position and ball travel direction detected by said detecting means, ball travel path, and based on the predicted travel path, in order that a ball not travel into preestablished lane-bordering regions, deciding upon which said discharging means is to discharge pressurized gas, and controlling said gas supplying means so as supply to the decided-upon discharging means pressurized gas timed, based on the ball speed detected by said detecting means, to when the ball passes a position above that discharging means, and cause the pressurized gas to be discharged for a fixed duration.

27. The bowling game system of claim 26, characterized in that said control means is configured to determine, based on handicaps defined in accordance with a players' skill, in which frames during a game said gas supplying means is to be activated, and to then monitor the progress of the game to supply pressurized gas from said gas supplying means to said discharging means when the game has reached an applicable frame.

28. The bowling game system of claim 1, characterized in that:

said discharging mechanism is configured by arranging along said lane lengthwise a plurality of discharging means disposed in a single row or multiple rows, embedded along said lane widthwise and provided with a plurality of discharging portions for discharging the pressurized gas directed upwards; and said gas supplying means is configured so as to feed the pressurized gas to each discharging portions of said discharging means; therein characterized in being further provided with position detecting means for detecting ball position in the lane widthwise, in position-detecting locations defined respectively corresponding to, and nearer to the approach end than, said discharging means; and a control means for controlling said gas supplying means so as to guide the ball toward a predetermined part of the bowling pins, by adjusting, in accordance with ball position in the position-detecting locations successively detected by said position detecting means, supply flow rate and/or supply pressure of the pressurized gas fed to each discharging portion of said discharge means corresponding to the position-detecting locations to vary the flow rate and/or pressure of the discharge from said discharging means.

29. The bowling game system of claim 28, characterized in that said control means is configured to determine, based on handicaps defined in accordance with a players' skill, in which frames during a game said gas supplying means is to be activated, and to then monitor the progress of the game to supply pressurized gas from said gas supplying means to said discharging means when the game has reached an applicable frame.

30. The bowling game system of claim 1, characterized in that:

said discharging mechanism is configured by arranging along said lane lengthwise a plurality of discharging means disposed in a single row or multiple rows, embedded along said lane widthwise and provided with a plurality of discharging portions for discharging the pressurized gas directed upwards; and said gas supplying means is configured so as to feed the pressurized gas to each discharging portions of said discharging means; therein characterized in being further provided with detecting means, more toward the approach-area end of the lane than that of said discharging means nearest the approach area, for detecting ball position in the lane widthwise, ball moving speed, and ball travel direction; and a control means for predicting, based on the ball position and ball travel direction detected by said detecting means, ball travel path, and based on the predicted travel path, in order to guide the ball toward a predetermined part of the bowling pins, deciding upon which said discharging means, and which of its discharging portions, is to discharge pressurized gas, and the discharge flow rate and/or discharge pressure at which to discharge from those discharging portions, and controlling said gas supplying means so as supply to the decided-upon discharging portions pressurized gas at a supply flow rate and/or supply pressure in accordance with the decided-upon discharge flow rate and/or discharge pressure, and timed, based on the ball speed detected by said detecting means, to when the ball passes a position above those discharging portions.

31. The bowling game system of claim 30, characterized in that said control means is configured to determine, based on handicaps defined in accordance with a players' skill, in which frames during a game said gas supplying means is to be activated, and to then monitor the progress of the game to supply pressurized gas from said gas supplying means to said discharging means when the game has reached an applicable frame.

* * * * *